US007837522B1

(12) United States Patent
Hoover et al.

(10) Patent No.: US 7,837,522 B1
(45) Date of Patent: Nov. 23, 2010

(54) ELECTRICAL CONTACTS WITH SOLDER MEMBERS AND METHODS OF ATTACHING SOLDER MEMBERS TO ELECTRICAL CONTACTS

(75) Inventors: David Hoover, Salem, IN (US); John Mongold, Middletown, PA (US); Donald Knowlden, Harrisburg, PA (US)

(73) Assignee: Samtec, Inc., New Albany, IN (US)

( * ) Notice: Subject to any disclaimer, the term of this patent is extended or adjusted under 35 U.S.C. 154(b) by 0 days.

(21) Appl. No.: 12/616,906

(22) Filed: Nov. 12, 2009

(51) Int. Cl.
*H01R 11/20* (2006.01)

(52) U.S. Cl. ..... 439/876; 439/83; 29/843; 29/874; 29/876; 29/877; 29/878; 29/879

(58) Field of Classification Search ..... 439/876, 439/83, 874; 29/843, 874, 876–879
See application file for complete search history.

(56) References Cited

U.S. PATENT DOCUMENTS 4,120,558 A 10/1978 Seidler
4,203,648 A 5/1980 Seidler
4,367,910 A 1/1983 Seidler
4,433,892 A 2/1984 Seidler
4,541,034 A * 9/1985 Fanning ..... 361/773
4,592,617 A 6/1986 Seidler
4,597,628 A 7/1986 Seidler
4,605,278 A 8/1986 Seidler
4,679,889 A 7/1987 Seidler
4,697,865 A 10/1987 Seidler
4,712,850 A 12/1987 Seidler
4,728,305 A 3/1988 Seidler
4,737,115 A 4/1988 Seidler
4,738,627 A 4/1988 Seidler
4,780,098 A 10/1988 Seidler
4,802,862 A 2/1989 Seidler
4,883,435 A 11/1989 Seidler
4,932,876 A 6/1990 Seidler
5,030,144 A 7/1991 Seidler
5,052,954 A 10/1991 Seidler
5,090,926 A 2/1992 Seidler
5,139,448 A 8/1992 Seidler
5,176,255 A 1/1993 Seidler
5,246,391 A 9/1993 Seidler
5,307,929 A 5/1994 Seidler
5,310,367 A 5/1994 Seidler
5,334,059 A 8/1994 Seidler
5,344,343 A 9/1994 Seidler
5,441,429 A 8/1995 Seidler
5,441,430 A 8/1995 Seidler
5,466,517 A 11/1995 Eschwey et al.

(Continued)

*Primary Examiner*—Gary F. Paumen
(74) *Attorney, Agent, or Firm*—Keating & Bennett, LLP

(57) ABSTRACT

An electrical contact including a head, a tail including an opposing pair of major surfaces and a hole, a body connected at one end thereof to the head and at another end thereof to the tail, a peg arranged adjacent to the hole and to extend perpendicular or substantially perpendicular to one of the opposing pair of major surfaces and including at least one beveled side, and a solder member attached to the tail such that the peg creates and fits in a protrusion in a surface of the solder member when the solder member is attached to the tail, such that a portion of the solder member extends into the hole, and such that the solder member engages the at least one beveled side of the peg.

20 Claims, 38 Drawing Sheets

U.S. PATENT DOCUMENTS 5,571,034 A 11/1996 Seidler
5,601,459 A 2/1997 Seidler
RE35,549 E 7/1997 Seidler
5,653,617 A 8/1997 Seidler
5,688,150 A 11/1997 Seidler et al.
5,875,546 A * 3/1999 Cachina et al. ..... 29/843
5,908,323 A 6/1999 Seidler
5,910,885 A 6/1999 Gulachenski et al.
6,099,365 A 8/2000 Cachina et al.
6,325,682 B1 12/2001 Seidler
6,402,574 B2 6/2002 Cachina et al.
6,494,754 B2 12/2002 Cachina et al.
6,692,265 B2 * 2/2004 Kung et al. ..... 439/68
6,796,485 B2 9/2004 Seidler
6,834,791 B2 12/2004 Seidler
6,870,091 B2 3/2005 Seidler
6,891,105 B1 5/2005 Bach et al.
6,969,286 B1 11/2005 Mongold et al.
7,189,083 B2 3/2007 Seidler et al.
7,322,855 B2 1/2008 Mongold et al.
2001/0041481 A1 * 11/2001 Cachina et al. ..... 439/876
2003/0114028 A1 * 6/2003 Ohkita et al. ..... 439/83
2003/0216067 A1 * 11/2003 Yeh ..... 439/83
2005/0059276 A1 * 3/2005 Lee et al. ..... 439/83
2008/0108255 A1 * 5/2008 Peloza et al. ..... 439/876
2009/0191730 A1 * 7/2009 Ito et al. ..... 439/83

* cited by examiner

ELECTRICAL CONTACTS WITH SOLDER MEMBERS AND METHODS OF ATTACHING SOLDER MEMBERS TO ELECTRICAL CONTACTS

BACKGROUND OF THE INVENTION

1. Field of the Invention

The present invention relates to electrical contacts and methods of manufacturing electrical contacts. More specifically, the present invention relates to electrical contacts with solder members and methods of attaching solder members to electrical contacts.

2. Description of the Related Art

It is well known to attach solder to electrical contacts of an electrical connector. The solder is used to form an electrical and mechanical connection between the electrical contact and an electrical pad on a printed circuit board.

U.S. Pat. No. 6,969,286 discloses a conventional method of attaching solder to a contact. FIG. 33 shows a portion of a ribbon 140 of such contacts 110 with solder 120. The solder 120 is attached to the contact 110 by inserting the solder 120 between opposing arms in the tail 113 of the contact 110 and crimping the solder 120 so that the solder 120 is located on two sides of the contact 110. The contact 110 includes a body 112 connecting the head 111 and the tail 113.

To allow contact 110 to be removed from ribbon 140 without dislodging the solder 120, the shoulders 112*a* of the body 112 of contact 110 are connected to the ribbon 140 at breakoffs 141, and the distance between the shoulders 112*a* and the solder 120 must be at least some fixed distance. The contact 110 cannot be connected at the bottom of the tail 113 of the contact 110 because of the arm design that holds the solder 120. Because the contacts 110 are attached at the shoulders 112*a* of the body 112, the width of the contacts 110 and the pitch between contacts 110 cannot be smaller than some fixed distance. The contacts 110 cannot be made smaller because there would be no room to locate the shoulders 112*a* with the breakoffs 141. The body 112 of the contact 110 is held in a core in an electrical connector. The contact 110 cannot be inserted into the core of the electrical connector past the shoulders 112*a*, even if each of the cores of the electrical connector includes a relief or a recess. Because the contact 110 cannot be inserted further, the distance between the bottom of the electrical connector and the bottom of the contact 110, including the solder 120, cannot be smaller than some fixed distance. Because this distance cannot be made smaller than a fixed distance, the stack height of the electrical connector (the minimum distance between two printed circuit boards that are joined together by a mated pair of electrical connectors) that uses the contact 110 cannot be made smaller than a fixed height.

U.S. Patent Application Publication No. 2008/0108255 discloses another method of attaching solder to a contact. FIG. 34 shows a carrier 240 of contacts 210 with solder 220. The solder 220 is inserted into an aperture 216 in the tail 213 of the contact 210 and then cold-formed to secure the solder 220 to the contact 210 so that solder 220 is formed mainly on only one side of the contact 210. The solder 220 has a width smaller than the width of the shoulders 212*a*. The bodies 212 of the contacts 210 are connected to each other at shoulders 212*a*, with the shoulders 212*a* of the contacts 210 on the ends connected to breakoffs 241 of the carrier 240. FIG. 35 shows a single contact 210 with the solder 220. The center portion of the solder 220 is pushed into the aperture 216 of the contact 210, which forms depression 222, as shown in FIG. 36. As seen in FIG. 37, the aperture 216 has a rectangular shape. In this arrangement, the solder 220 is attached to the contact 210 only at a single point of attachment. As seen in FIG. 38, the solder 220 can be easily rotated with respect to the contact 210. The contact 210 cannot be inserted into the core of an electrical connector past the shoulders 212*a*, even if the each of the cores of the electrical connector includes a relief or a recess. Because the contact 110 cannot be inserted further, the distance between the bottom of the electrical connector and the bottom of the contact 210, including the solder 220, cannot be smaller than some fixed distance. As with an electrical connector using the contact 210, because this distance cannot be made smaller than a fixed distance, the stack height of the electrical connector (the minimum distance between two printed circuit boards that are joined together by a mated pair of electrical connectors) that uses the contact 210 cannot be made smaller than a fixed height.

To allow the machinery required to the remove carrier 240 at breakoffs 241 and to be able to later separate the contacts 210 from each other by separation cuts at the shoulder 212*a*, the contacts 210 are attached at the shoulders 212*a*, with the shoulders 212*a* of the contacts 210 on the ends connected to breakoffs 241 of the carrier 240, and the distance between the shoulders 212*a* and the solder 220 must be at least some fixed distance.

Because the contacts 210 are attached at the shoulder 212*a* of the body 212, the width of the contacts 210 and the pitch between contacts 210 cannot be smaller than some fixed distance. The contacts 210 cannot be made smaller because there would be no room to locate the shoulders 212*a* with the breakoffs 241.

The solder 220 is not reliably secured to the contact 210, which allows the solder 220 to rotate out of position or become dislodged during shipping, handling, or assembly. As seen in FIG. 36, the single point of attachment at the aperture 216 results in the solder 220 being easily sheared-off and easily pushed-out. Because the aperture 216 is nearly a square shape, the solder 220 is minimally prevented from rotating.

SUMMARY OF THE INVENTION

To overcome the problems described above, preferred embodiments of the present invention provide an electrical contact with a securely and reliably attached solder member and a method of manufacturing an electrical contact with a securely and reliably attached solder member, even for small sized electrical contacts, which allows for electrical connectors with small electrical contact pitches and/or with short stack heights.

According to a preferred embodiment of the present invention, an electrical contact includes a head, a tail having an opposing pair of major surfaces and having a hole, a body connected at one end to the head and at another end to the tail, a peg arranged adjacent to the hole and to extend perpendicular or substantially perpendicular to one of the opposing pair of major surfaces and having at least one beveled side, and a solder member attached to the tail such that the peg creates and fits in a protrusion in a surface of the solder member when the solder member is attached to the tail, such that a portion of the solder member extends into the hole, and such that the solder member engages the at least one beveled side of the peg.

The electrical contact preferably further includes at least one arm extending from the body. The peg preferably includes a bell-curve shaped top extending above the at least one beveled side. The peg preferably includes a top extending above the at least one beveled side of the peg and having at least one top beveled side. The at least one beveled side of the peg is preferably arranged is such that a width of the peg increases in a direction extending away from the one of the opposing pair of major surfaces.

According to a preferred embodiment of the present invention, an electrical connector includes at least one electrical contact according to another of the preferred embodiments of the present invention.

The at least one electrical contact preferably includes a plurality of electrical contacts arranged into an array of electrical contacts. The head of the at least one electrical contact is preferably arranged to engage with a corresponding electrical contact of another electrical connector. The solder member of the at least one electrical contact is preferably arranged to be fused to the tail of the at least one electrical contact and to be fused with an electrical pad on a printed circuit board.

According to a preferred embodiment of the present invention, an electrical connector system includes an electrical connector having at least one electrical contact according to another of the preferred embodiments of the present invention and a printed circuit board having at least one electrical pad. For each of the at least one electrical contact, the solder member is fused to the tail of the electrical contact and is fused to a corresponding one of the at least one electrical pad.

According to a preferred embodiment of the present invention, a method of manufacturing an electrical contact includes the steps of providing an electrical contact having a head, a tail having an opposing pair of major surfaces and having a hole, and a body connected at one end to the head and at another end to the tail; forming a peg adjacent to the hole so that the peg extends perpendicular or substantially perpendicular to one of the opposing pair of major surfaces and has at least one beveled side; and attaching a solder member to the tail such that the peg creates and fits in a protrusion in a surface of the solder member, such that a portion of the solder member extends into the hole, and such that the solder member engages the at least one beveled side of the peg.

The step of attaching preferably includes forming a depression in the solder member such that the portion of the solder member extending into the hole is formed. The step of attaching preferably includes pressing the solder member to form beveled sides in the solder member so that the solder member engages the at least one beveled side of the peg. A method of manufacturing an electrical contact preferably further includes forming at least one arm extending from the body. The step of forming the peg preferably includes forming a bell-curve shaped top extending above the at least one beveled side. The step of forming the peg preferably includes forming a top extending above the at least one beveled side of the peg and having at least one top beveled side. The at least one beveled side of the peg is preferably arranged is such that a width of the peg increases in a direction extending away from the one of the opposing pair of major surfaces.

According to a preferred embodiment of the present invention, a method of manufacturing an electrical connector includes providing an electrical connector with at least one electrical contact formed according to another preferred embodiment of the present invention.

According to a preferred embodiment of the present invention, a method of manufacturing an electrical connector system includes providing an electrical connector with at least one electrical contact formed according to another preferred embodiment of the present invention, providing a printed circuit board having at least one electrical pad, and fusing the solder member for each of the at least one electrical contact to the tail of the electrical contact and to a corresponding one of the at least one electrical pad.

According to a preferred embodiment of the present invention, a ribbon of electrical contacts includes a ribbon and electrical contacts connected to the ribbon. Each of the electrical contacts includes a head, a tail including a hole and a peg and connected to the ribbon such that a bottom portion of the tail is the only portion of the electrical contact connected to the ribbon, and a solder member connected to the tail such that a portion of the solder member surrounds the peg, such that a portion of the solder member is located within the hole, and such that the solder member overlaps both the tail and the ribbon.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
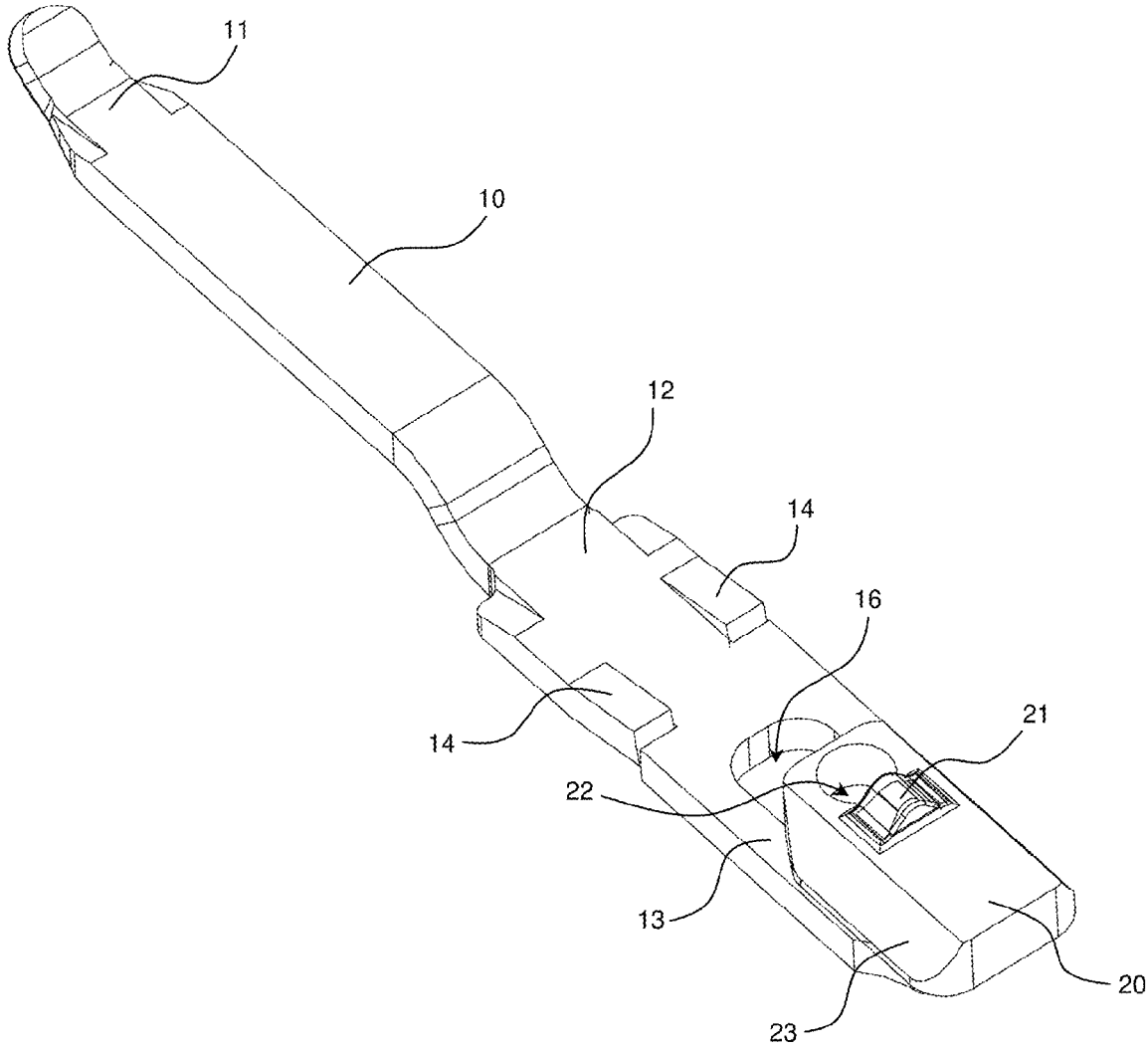
FIG. 1 is a perspective view of an electrical contact with a solder member according to a preferred embodiment of the present invention.
Figure 2:
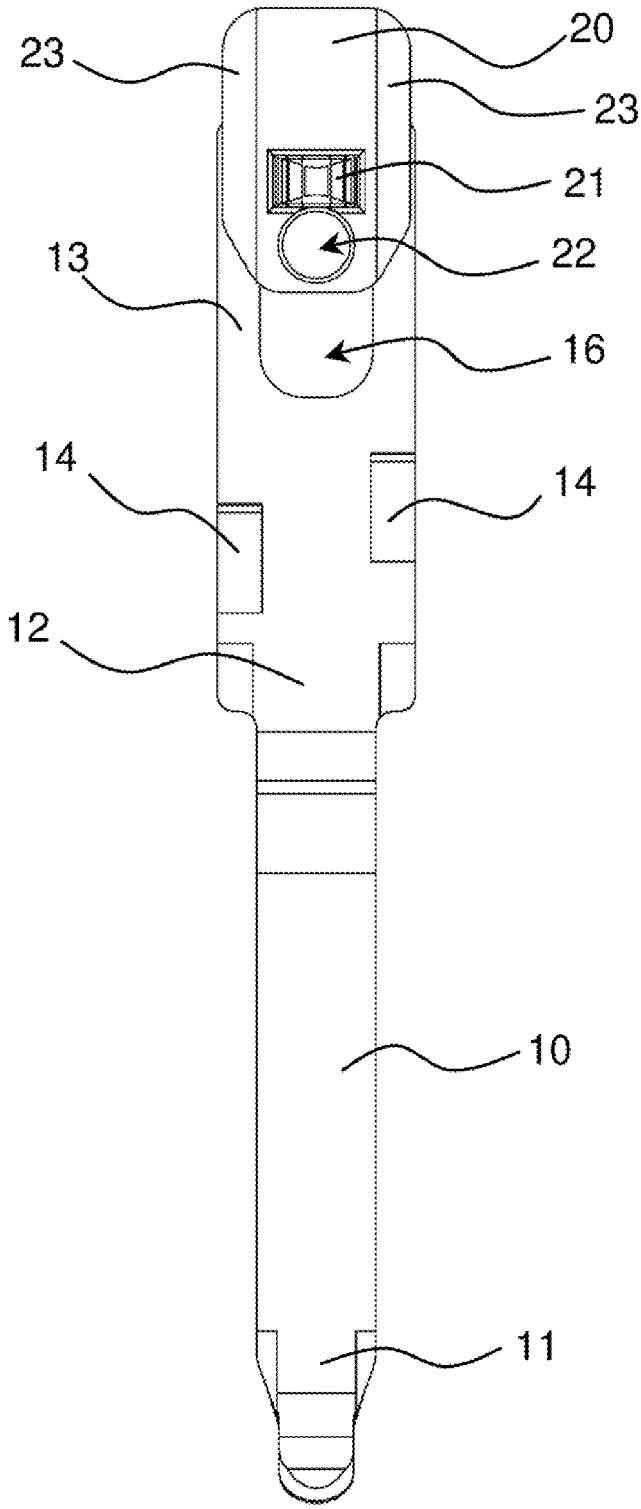
FIG. 2 is a front view of an electrical contact with a solder member according to a preferred embodiment of the present invention.
Figure 3:
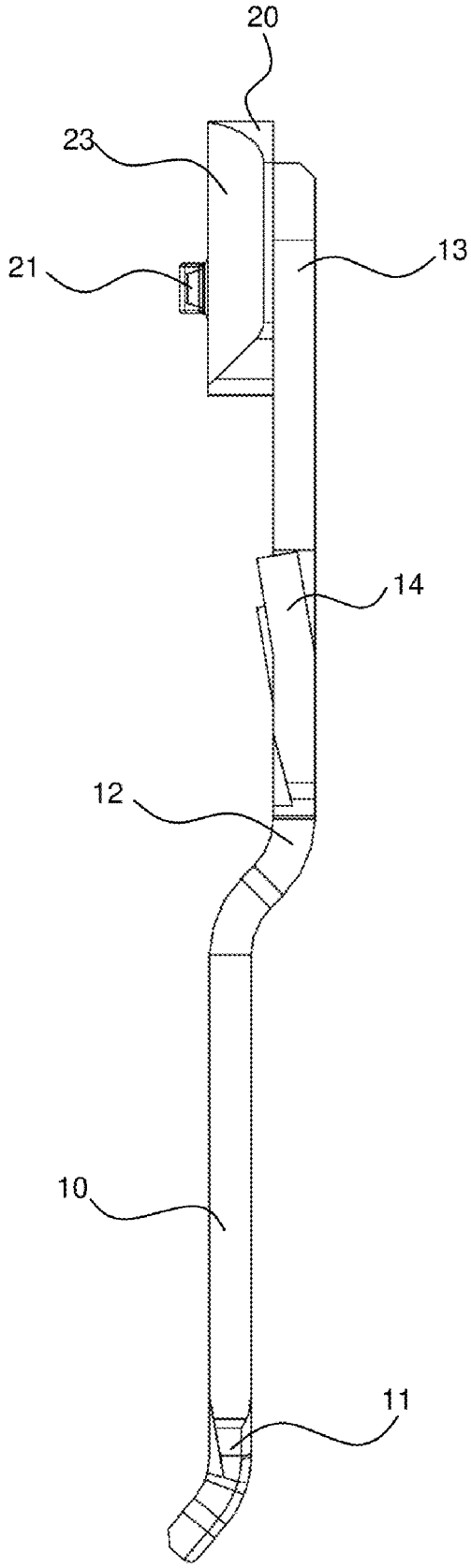
FIG. 3 is a side view of an electrical contact with a solder member according to a preferred embodiment of the present invention.
Figure 4:
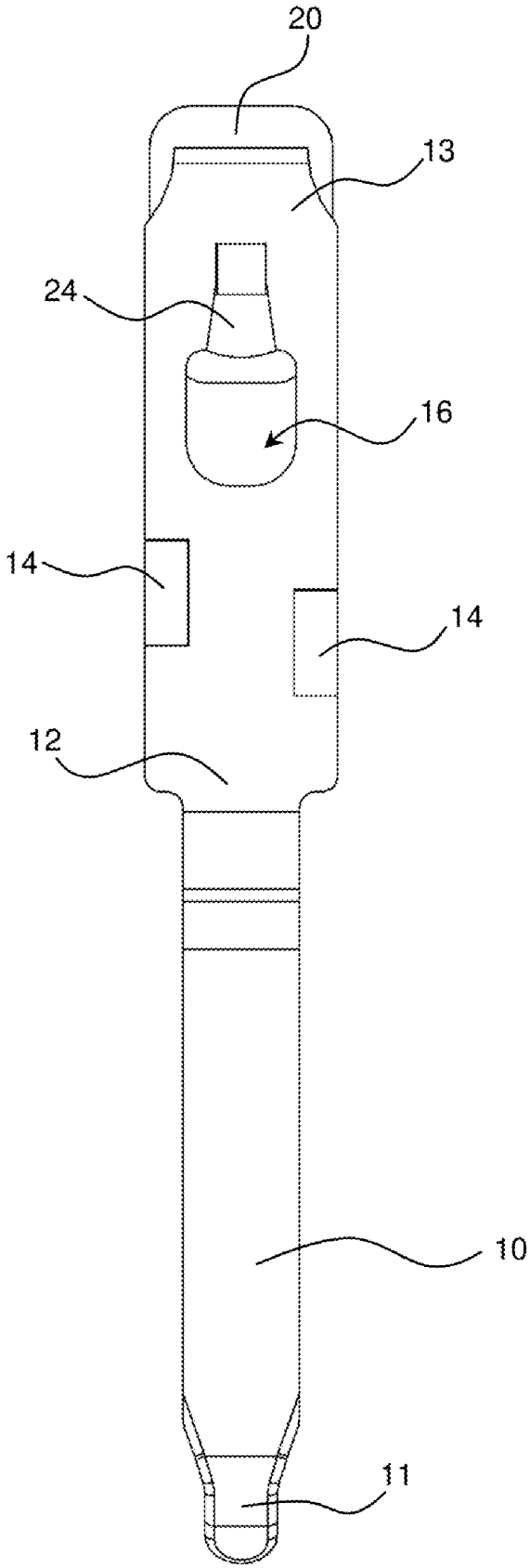
FIG. 4 is a back view of an electrical contact with a solder member according to a preferred embodiment of the present invention.
Figure 5:
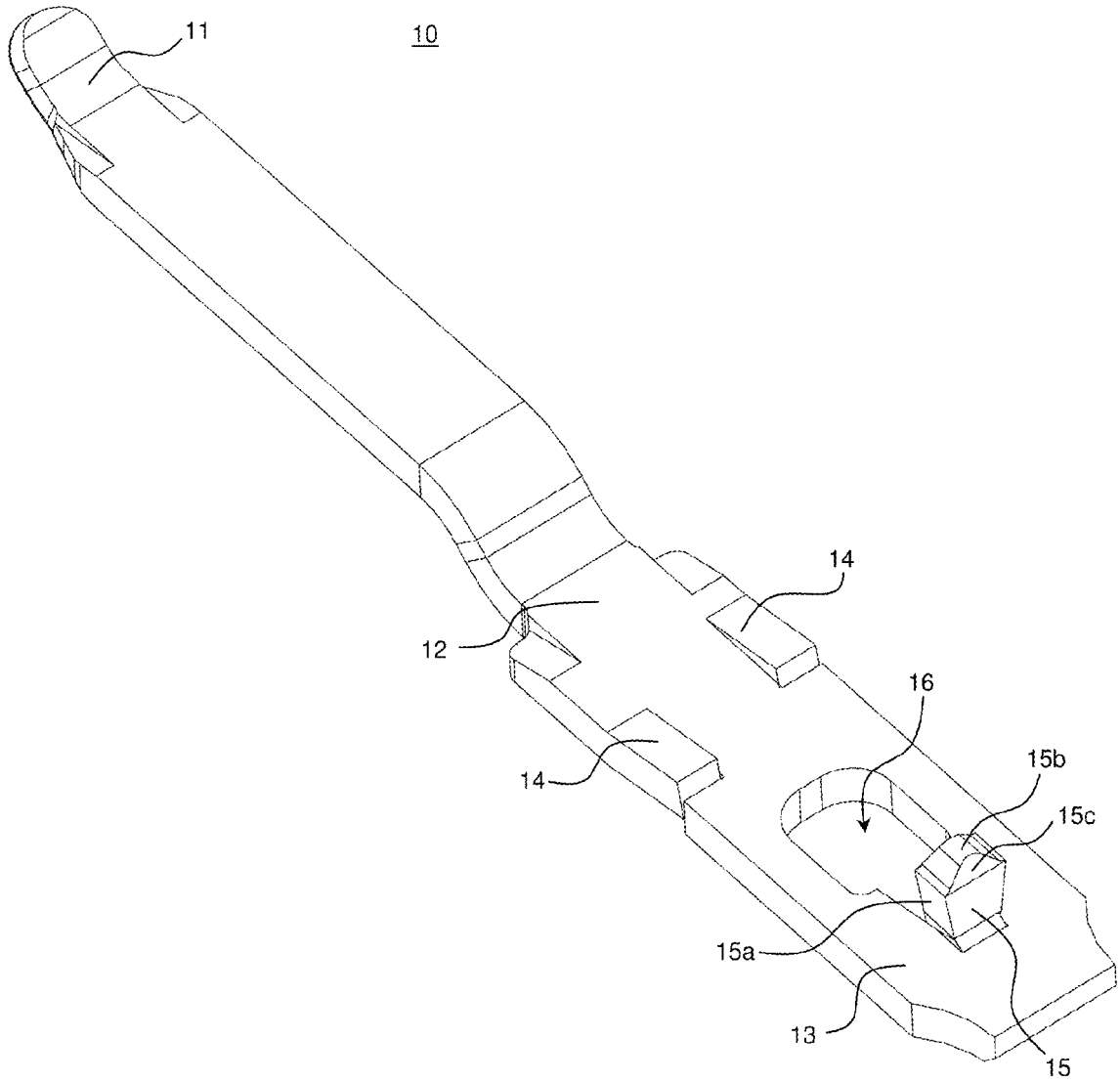
FIG. 5 is a perspective view of an electrical contact without a solder member according to a preferred embodiment of the present invention.
Figure 6:
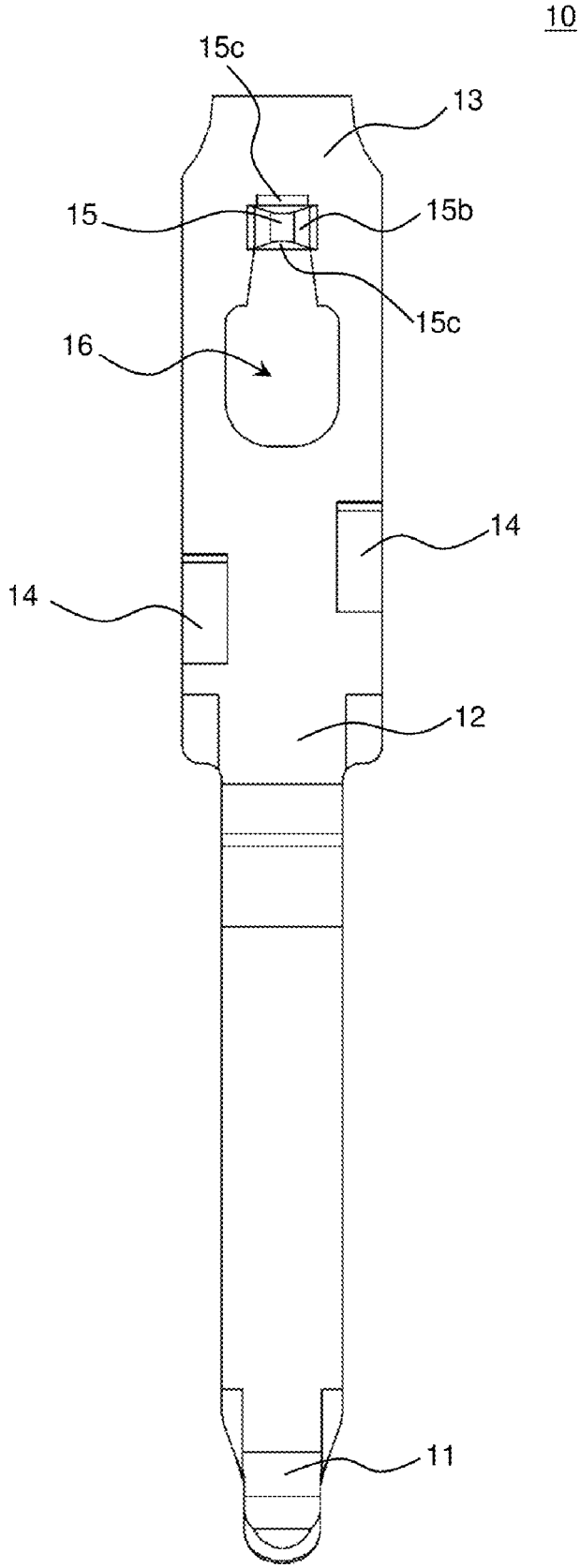
FIG. 6 is a front view of an electrical contact without a solder member according to a preferred embodiment of the present invention.
Figure 7:
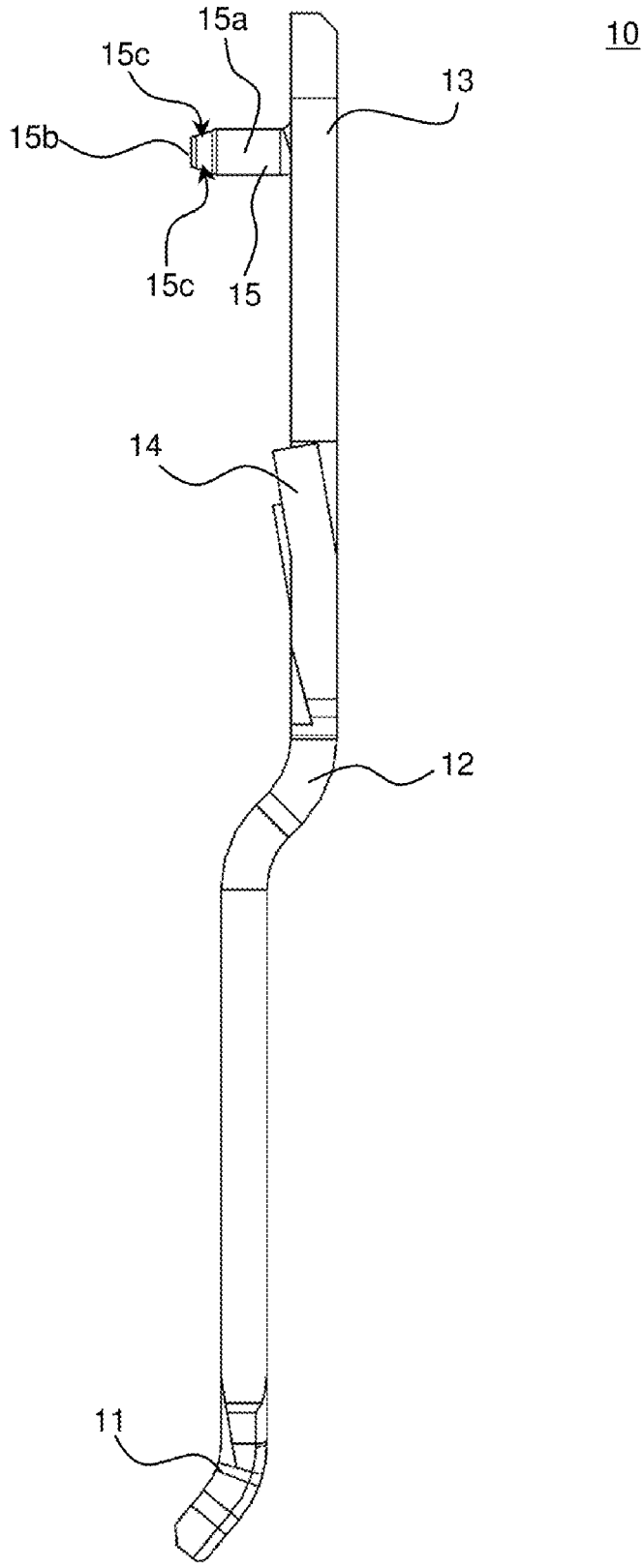
FIG. 7 is a side view of an electrical contact without a solder member according to a preferred embodiment of the present invention.
Figure 8:
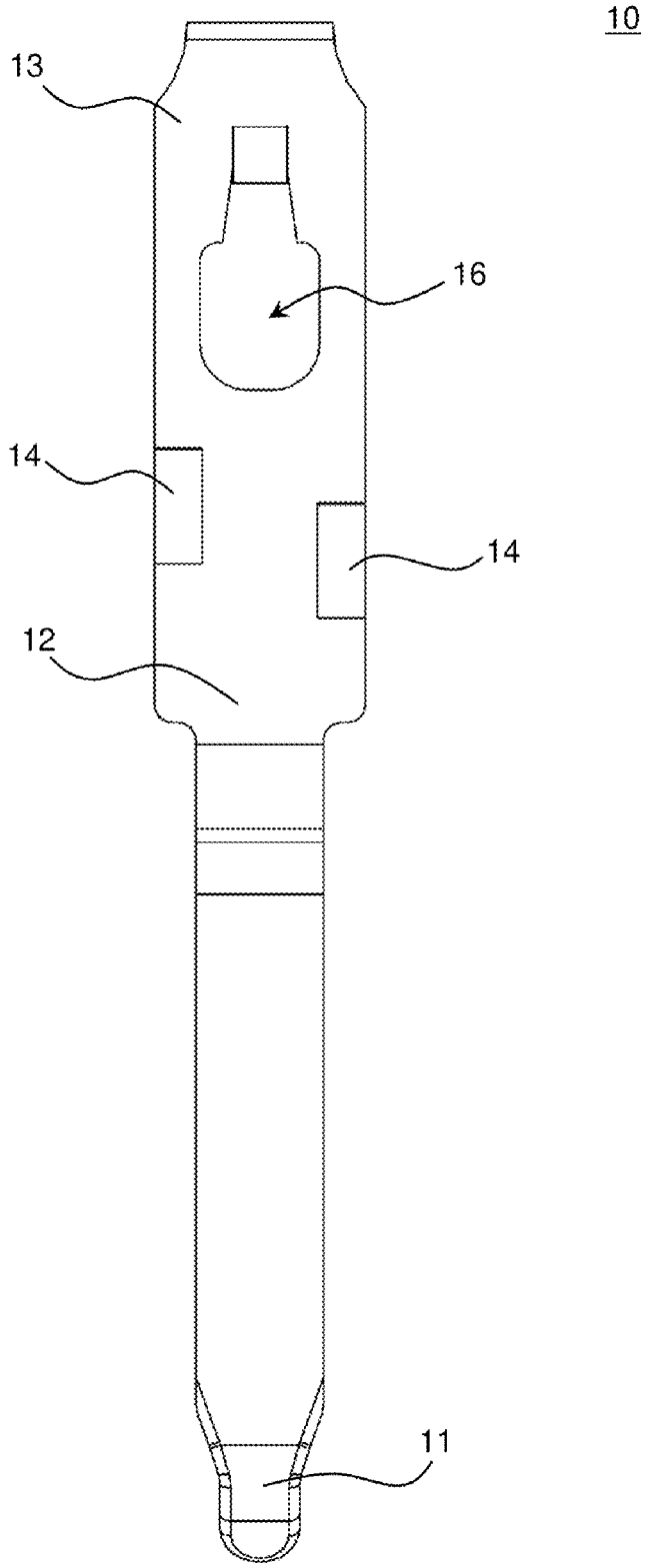
FIG. 8 is a back view of an electrical contact without a solder member according to a preferred embodiment of the present invention.
Figure 9:
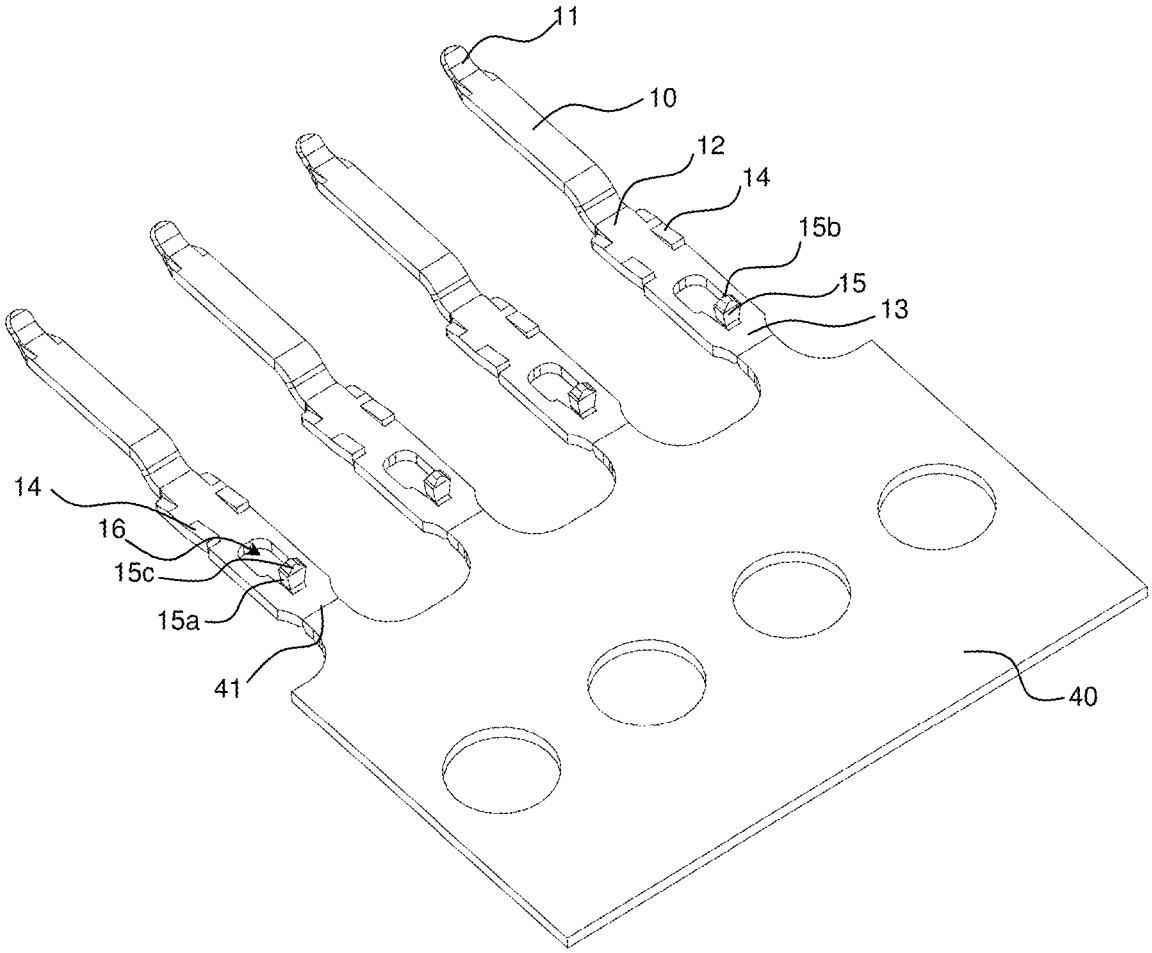
FIG. 9 is a perspective view of a portion of a ribbon of electrical contacts without solder members according to a preferred embodiment of the present invention.
Figure 10:
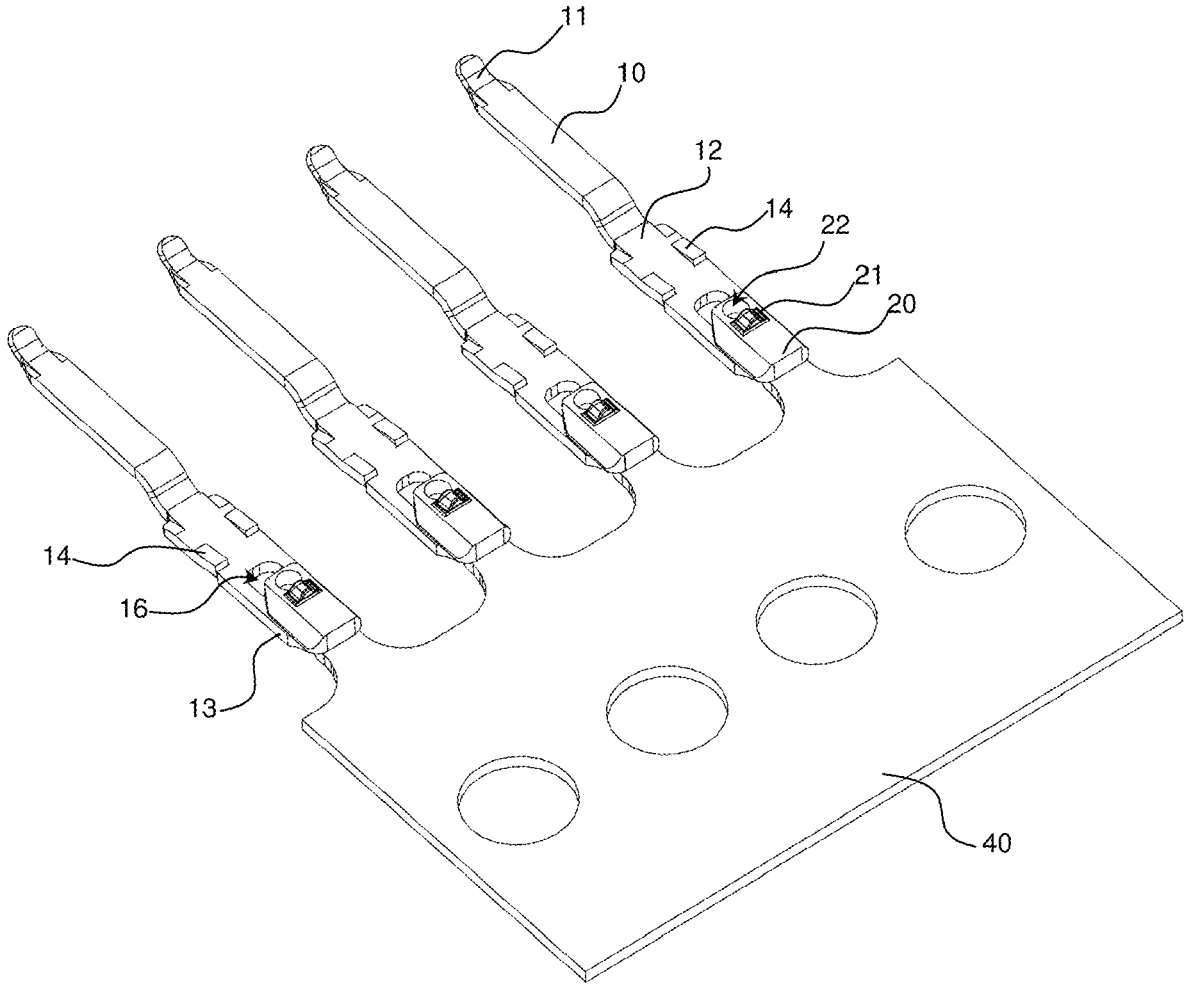
FIG. 10 is a perspective view of a portion of a ribbon of electrical contacts with solder members according to a preferred embodiment of the present invention.

Preferred embodiments of the present invention will be discussed in relation to FIGS. 1-32. FIGS. 1-4 and 27-29 show electrical contact 10 with solder member 20; FIGS. 5-8 show electrical contact 10 without solder member 20; FIGS. 9, 10, and 26 show a ribbon 40 of electrical contacts 10; FIGS. 11-14 show solder member 20; FIGS. 15-19 and 30-32 show the tail 13 of electrical contact 10; and FIGS. 20-25 show views of electrical connectors 50.

First, electrical contacts 10 and electrical connectors 50 according to preferred embodiments of the present invention will be described. Second, methods of manufacturing electrical contacts 10 according to preferred embodiments of the present invention will be described.

Electrical Contacts 10 and Electrical Connectors 50

FIGS. 1-4 and 27-29 show the electrical contact 10 with the solder member 20, FIGS. 5-8 show the electrical contact 10 without the solder member 20, FIGS. 15-19 and 30-32 show the tail 13 of the electrical contact 10, and FIGS. 20-25 show electrical connectors 50. The electrical contact 10 includes a head 11, a body 12, and a tail 13. The head 11 is connected to one end of the body 12, and the tail 13 is connected to the other end of the body 12. Electrical contact 10 includes arms 14 that extend from the body 12, a peg 15 (see FIGS. 5-8, for example) that extends perpendicular or substantially perpendicular to a major surface of the tail 13, and a hole 16 that is located in the tail 13.

Figure 21:
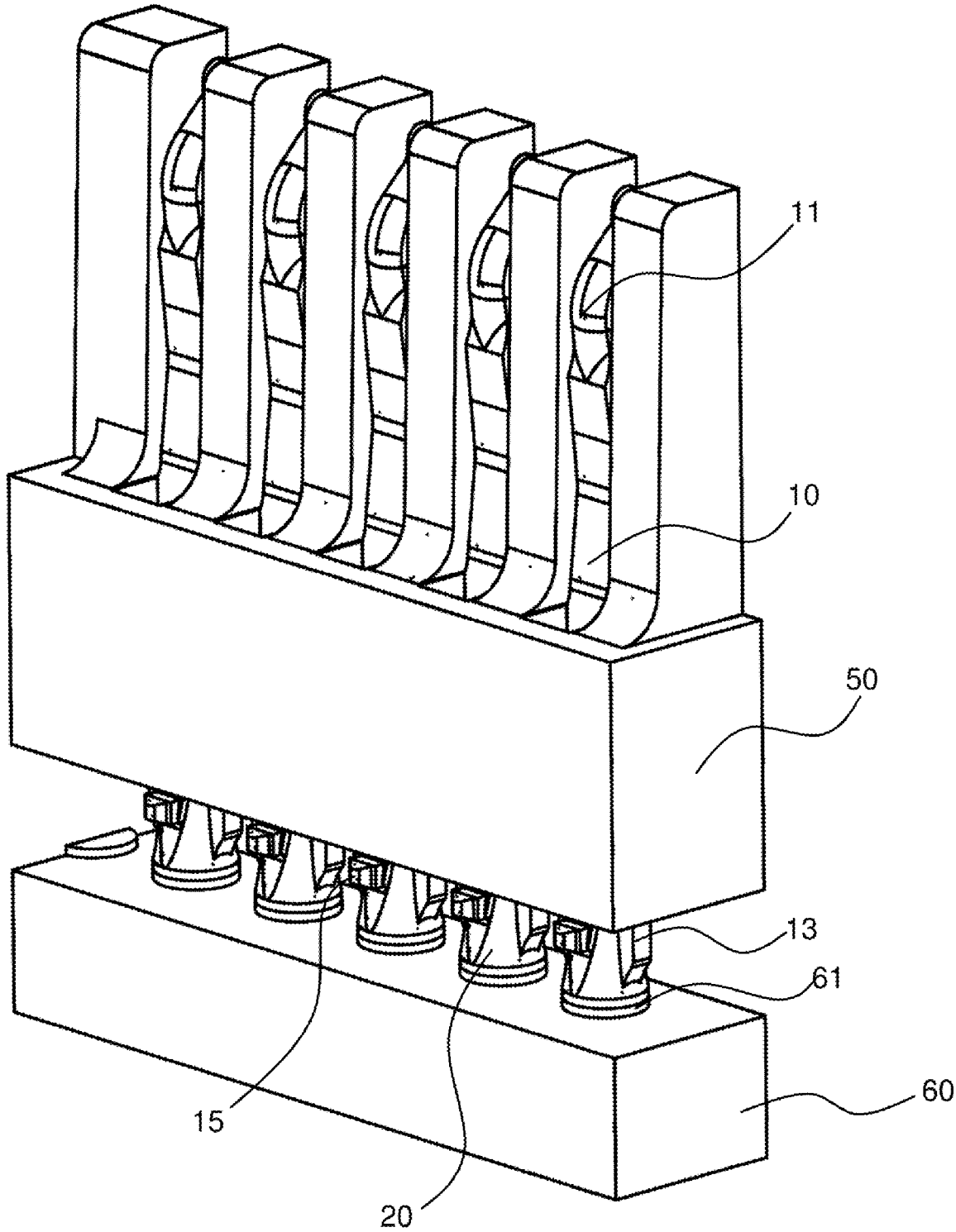
FIG. 21 is a perspective view of an electrical connector connected to a printed circuit board according to a preferred embodiment of the present invention.
Figure 22:
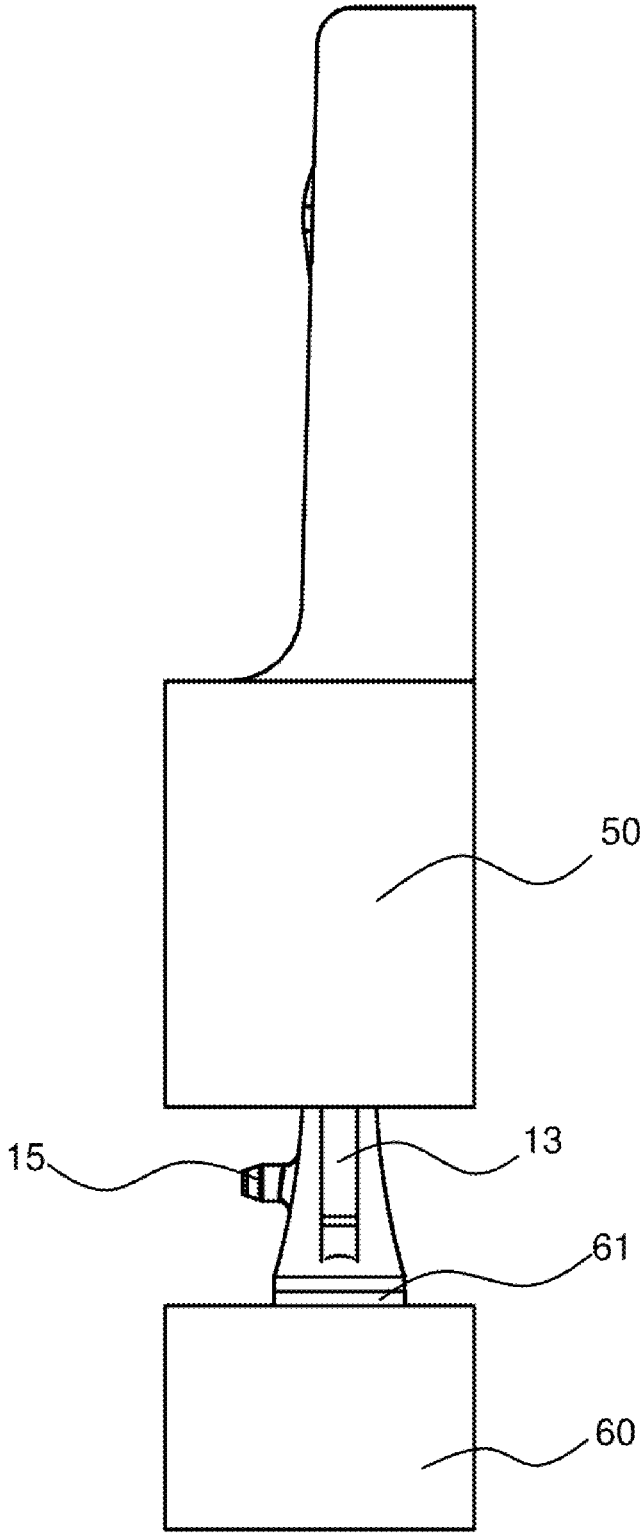
FIG. 22 is a side view of an electrical connector connected to a printed circuit board according to a preferred embodiment of the present invention.
Figure 23:
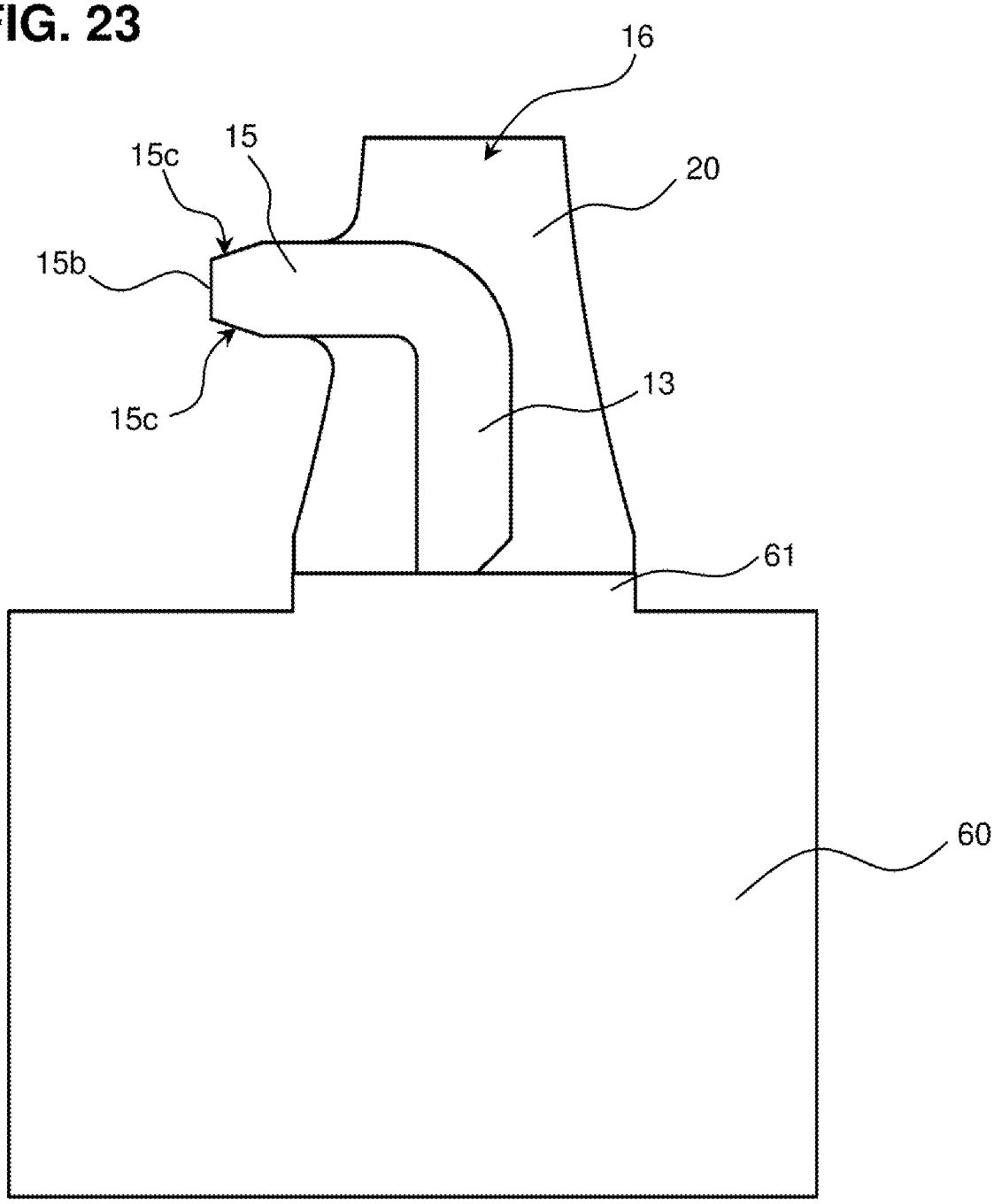
FIG. 23 is a side sectional view of a portion of an electrical contact connected to a printed circuit board according to a preferred embodiment of the present invention.

Electrical contacts 10 of preferred embodiments of the present invention are preferably used in electrical connectors 50 (shown, for example, in FIGS. 20-25) to form an array of electrical contacts 10. The solder members 20 of the electrical contacts 10 of the electrical connectors 50 are preferably soldered to corresponding electrical pads 61 of printed circuit boards, as shown in FIGS. 21-23 with a single electrical connector 50 and in FIGS. 24 and 25 with a pair of electrical connectors 50. FIG. 21 shows the electrical connector 50 before being soldered to the printed circuit board 60, and FIGS. 21-23 shows the electrical connector 50 after being soldered to the printed circuit board 60. As best seen in FIG. 23, after the electrical connector 50 is soldered to the printed circuit board 60, the solder member 50 has reflowed such that the peg 15 is partially covered by the solder member 20 and such that all sides of the electrical contact 10 are covered by the solder member 20.

For simplicity, FIGS. 20-25 show an array of electrical contacts 10 including a single row of electrical contacts 10 and a corresponding array of electrical pads 61 including a single row of electrical pads 61. However, any number of rows of electrical contacts 10, and corresponding electrical pads 61, can be used. The rows of the electrical connector 50 can be arranged in any suitable manner, including the stretched and staggered arrangement discussed in U.S. Pat. No. 7,322,855, the entire contents of which are incorporated by reference. It is possible that the arrangement of the rows in one portion of the electrical connector 50 is different from the arrangement of rows in another portion of the electrical connector 50. Although not shown, it is possible for the electrical connector 50 to include a ground shield extending along the perimeter of the electrical connector 50 and/or one or more ground planes extending between rows of electrical contacts 10.

The electrical contacts 10 are preferably formed on a ribbon 40, as shown in FIGS. 9, 10, and 26. As seen by comparing FIGS. 9 and 10 with FIG. 26, the pitch between the electrical contacts 10 on the ribbon 40 can be varied. The pitch of the electrical contacts 10 on the ribbon 40 is typically selected to match the pitch of the electrical contacts 10 in the electrical connector 50. This allows the electrical contacts 10 to be easily inserted into the electrical connector 50 while on the ribbon 40. It is also possible to remove electrical contacts 10 from the ribbon 40 and the individually insert the electrical contacts 10 into connector 50.

Figure 33:
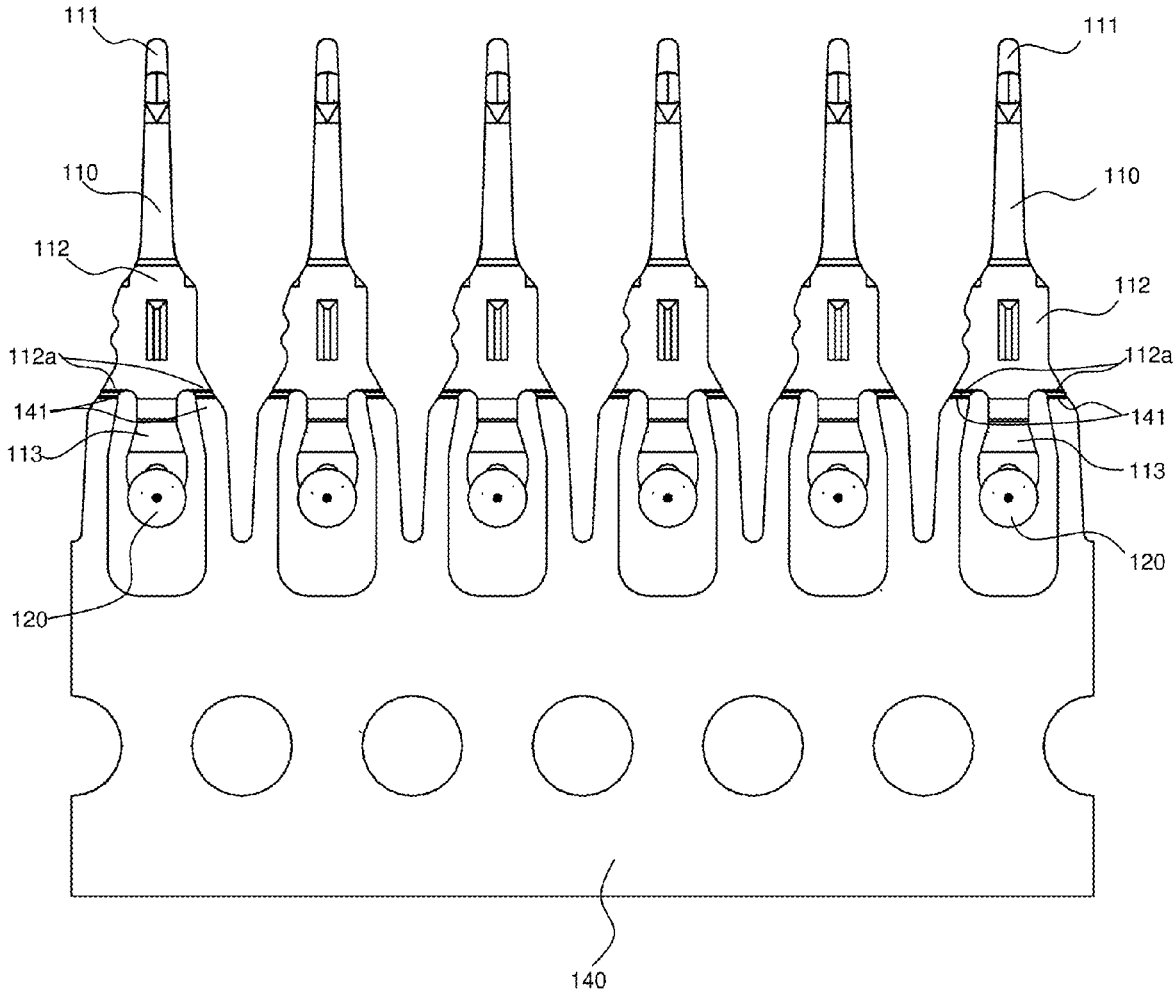
FIG. 33 PRIOR ART
FIG. 33 is a front view of a portion of a ribbon of conventional electrical contacts with solder members.
Figure 34:
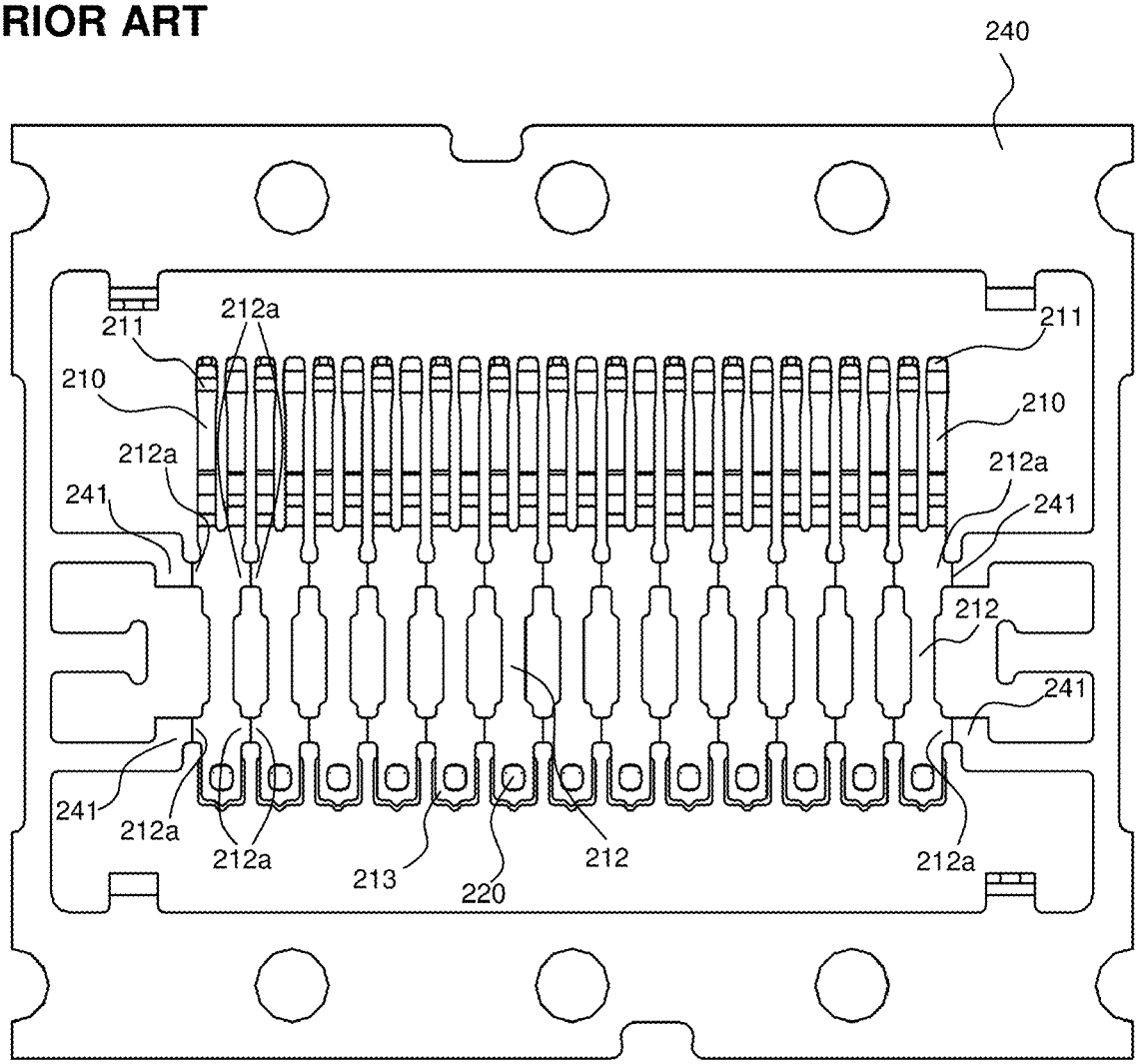
FIG. 34 PRIOR ART
FIG. 34 is a back view of a ribbon of conventional electrical contacts with solder members.
Figure 35:
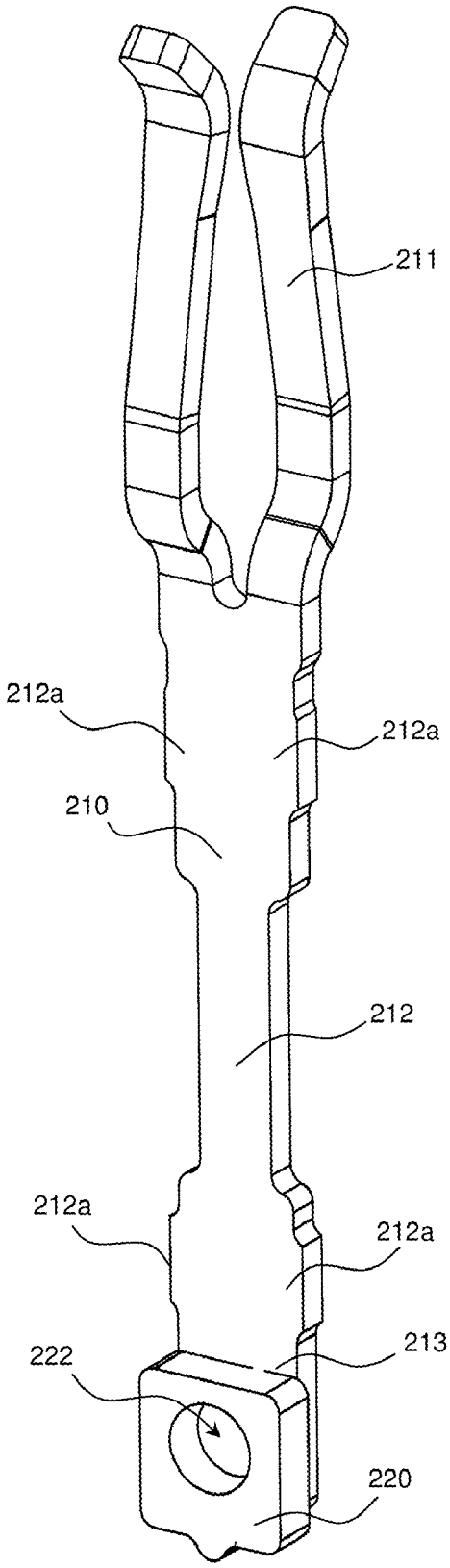
FIG. 35 PRIOR ART
FIG. 35 is a perspective view of a conventional electrical contact with a solder member.
Figure 36:
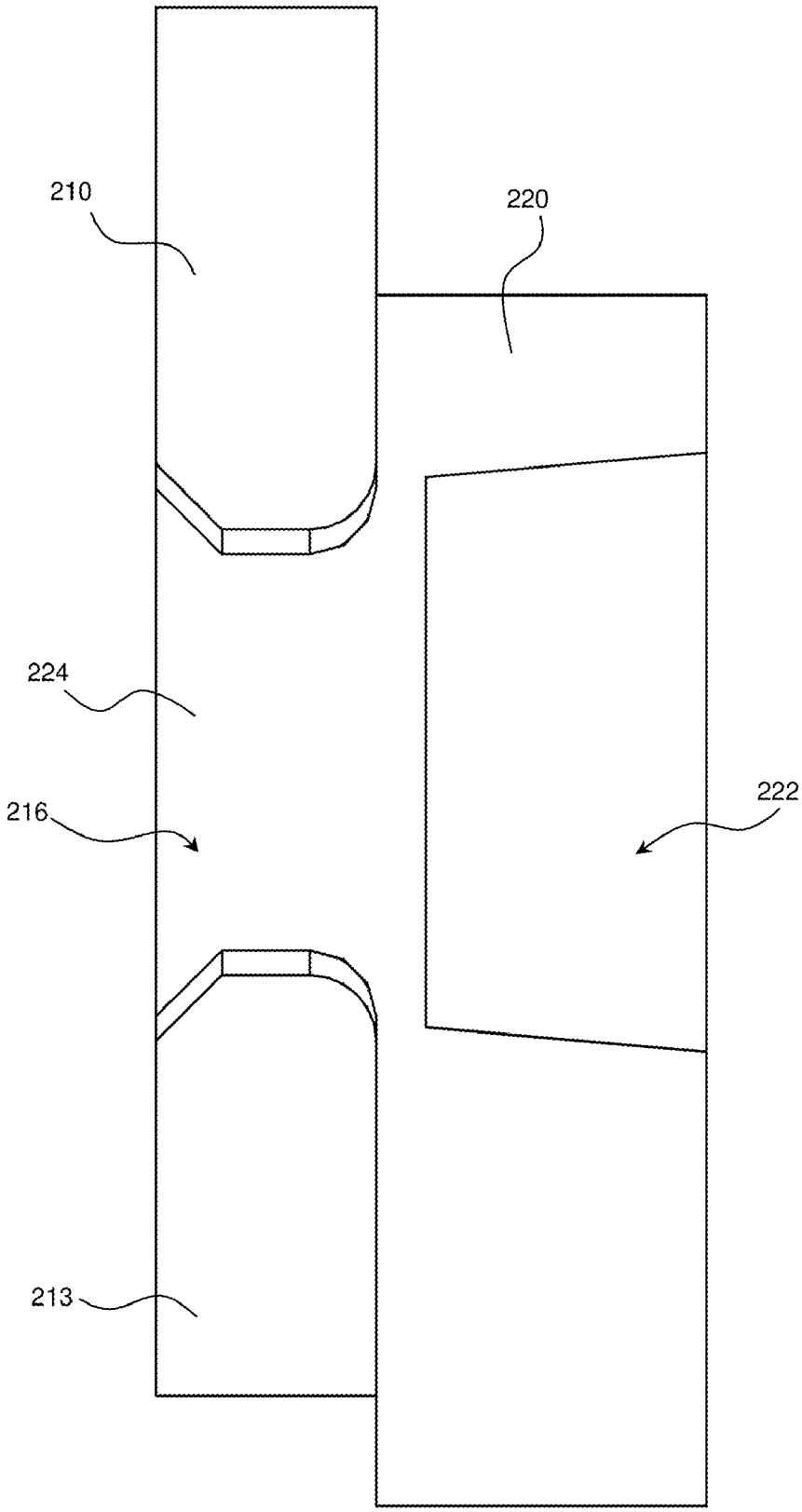
FIG. 36 PRIOR ART
FIG. 36 is a side sectional view of a conventional electrical contact with a solder member.
Figure 37:
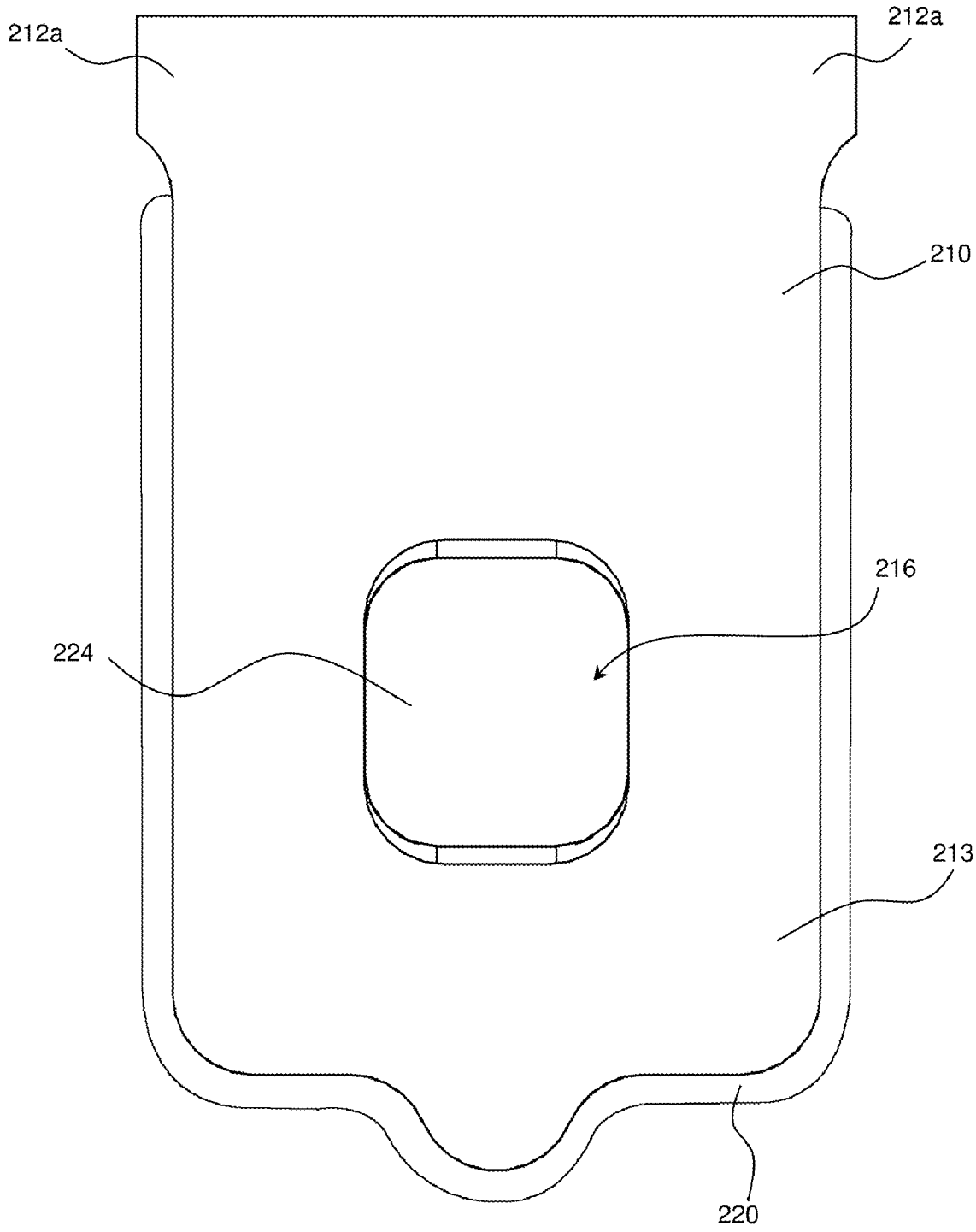
FIG. 37 PRIOR ART
FIG. 37 is a partial close-up back view of a portion of a conventional electrical contact with a solder member.
Figure 38:
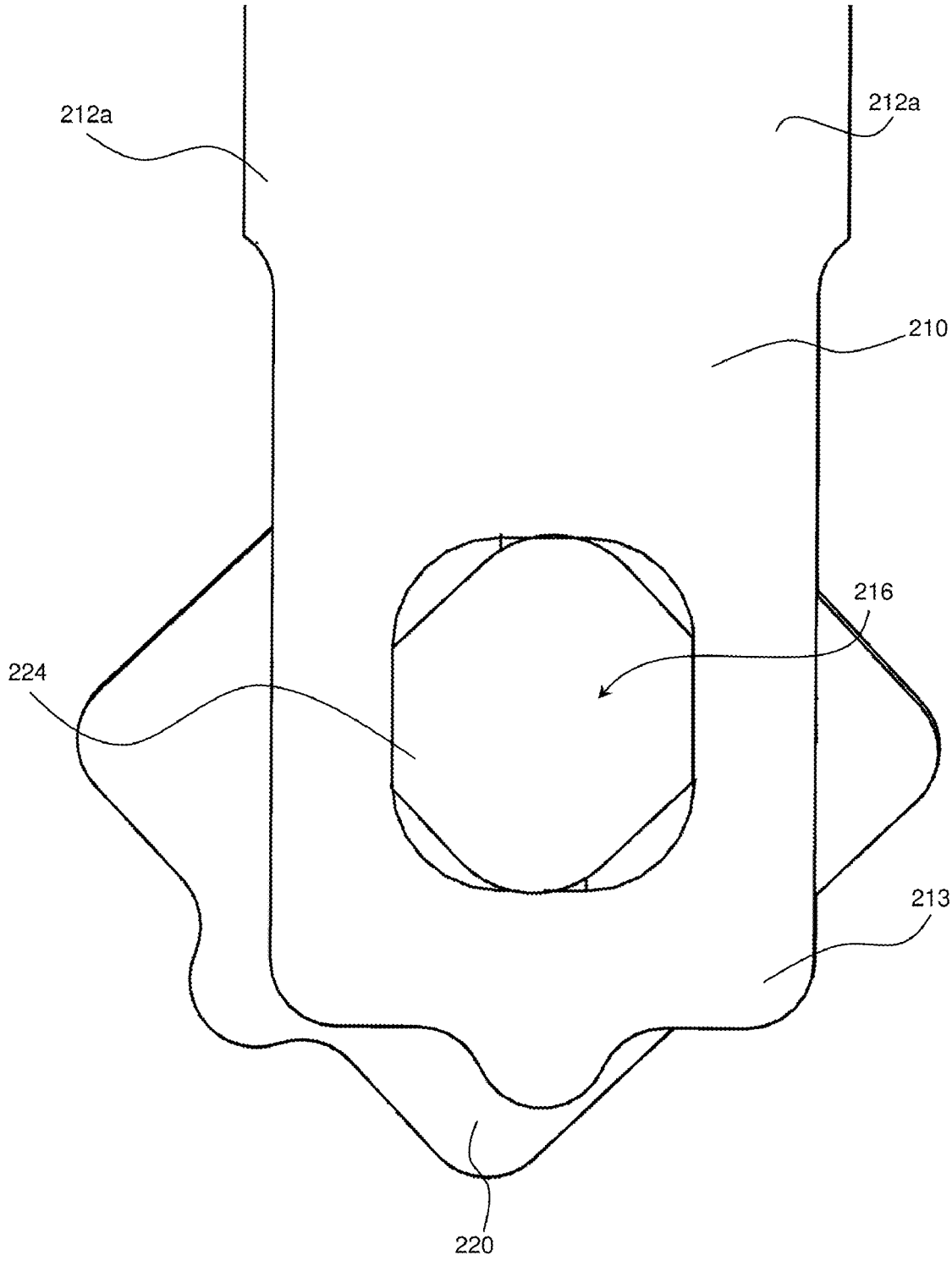
FIG. 38 PRIOR ART
FIG. 38 is a partial close-up back view of a portion of a conventional electrical contact with a rotated solder member.

Because most, if not all, of the solder member 20 is located on one side of the electrical contact 10, only the bottom of the tails 13, instead of the shoulder 112*a* or 212*a* of the body 112 or 212 as shown in Prior Art FIGS. 33 and 34, of the electrical contacts 10 are connected to breakoff 41 of the ribbon 40. By moving the breakoffs 41 to the bottom of the tails 13, the pitch between the electrical contacts 10 can be smaller than the pitch of the contacts 110 or 210 shown in Prior Art FIGS. 33 and 34. This allows the electrical contacts 10 to be used in electrical connectors 50 having a pitch smaller than the pitch of the electrical connectors that use the contacts 110 and 210 shown in Prior Art FIGS. 33 and 34. Because the electrical contacts 10 do not have shoulders 112*a* or 212*a* and because the solder member 20 is narrower than the electrical contact 10, the electrical contact 10 can be inserted further into the electrical connector 50. If the cores of the electrical connector 50 into which the electrical contacts 10 are inserted includes a relief or recess, then the electrical contact 10 can be even further inserted into the electrical connector 50, past the top of the solder members 20 such that solder members 20 are inserted into the relief or recess. Thus, the distance between the bottom of the electrical connector 50 and the bottom of the electrical contact 10, including solder member 20, can be set to any desirable distance.

Figure 24:
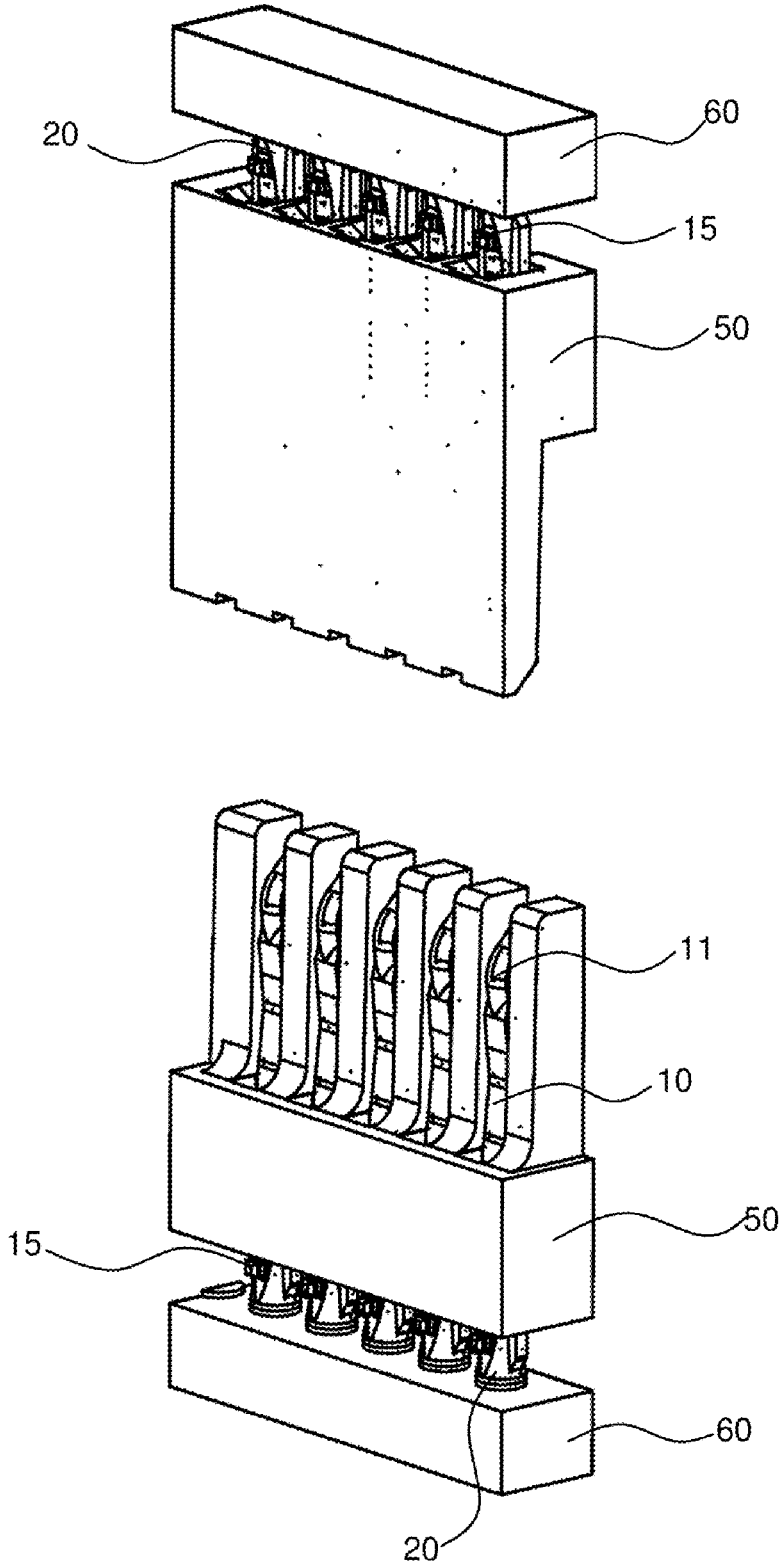
FIG. 24 is a perspective view of a pair of electrical connectors before being mated according to a preferred embodiment of the present invention.
Figure 25:
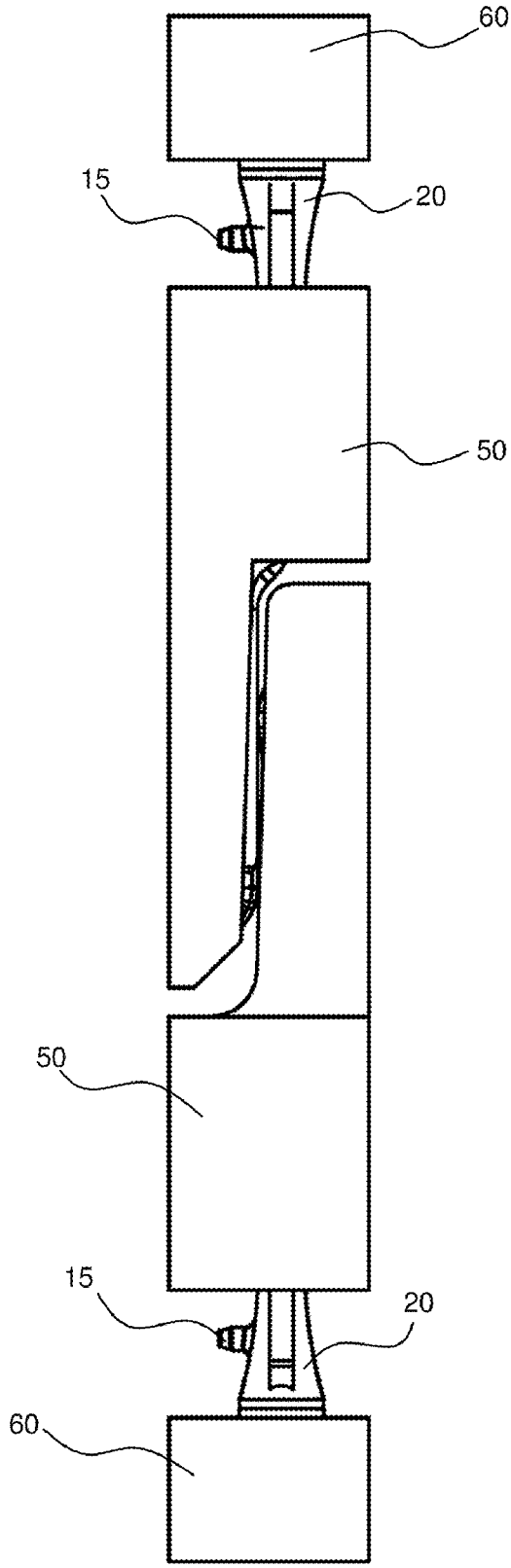
FIG. 25 is a perspective view of a mated pair electrical connectors according to a preferred embodiment of the present invention.
Figure 26:
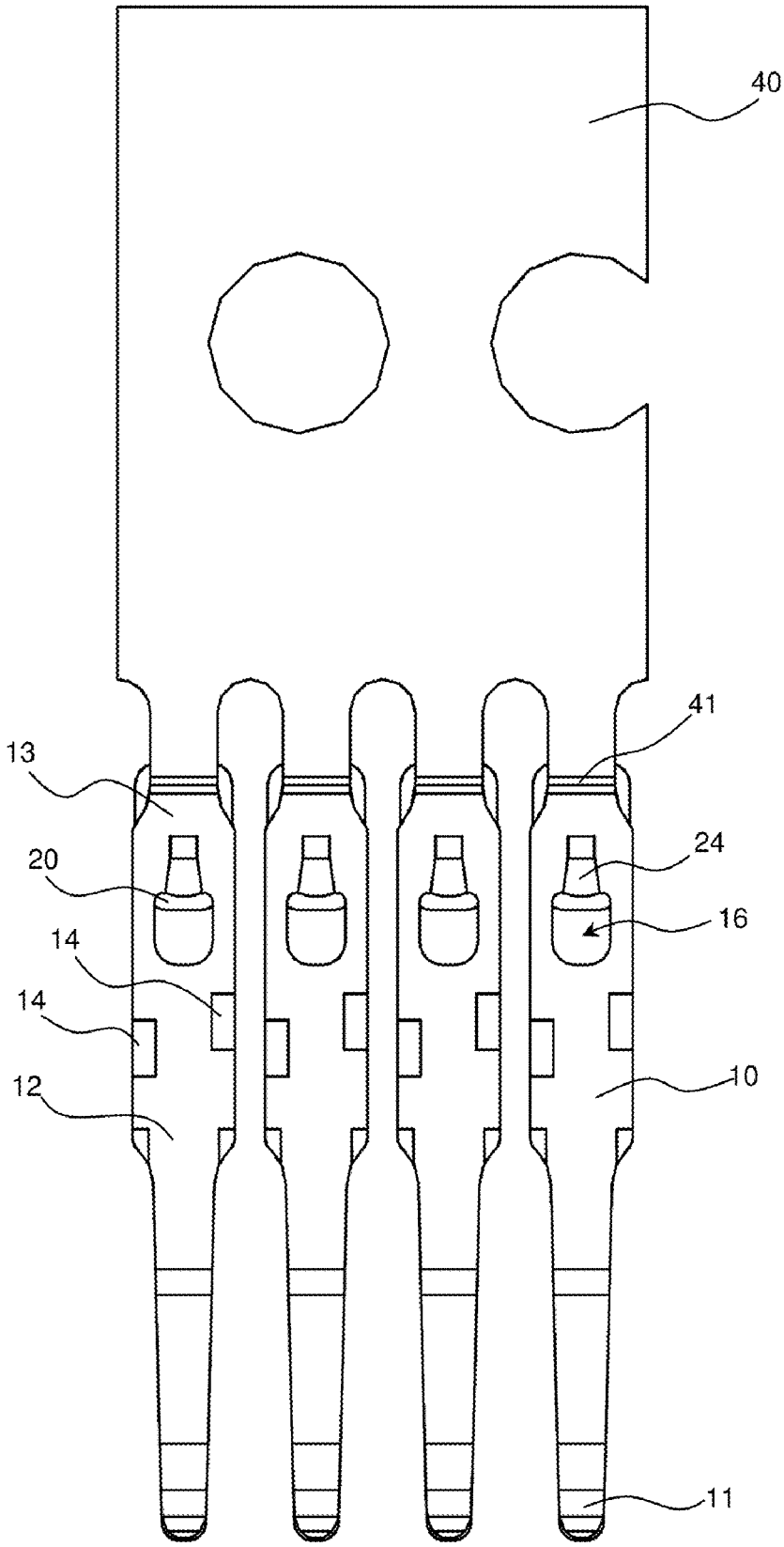
FIG. 26 is front view of a portion of a ribbon of electrical contacts with solder members according to a preferred embodiment of the present invention.

The head 11 of the electrical contact 10 is preferably arranged to engage the head 11 of a corresponding electrical contact 10 in another electrical connector 50, as shown in FIGS. 24 and 25. The arrangement of the head 11 can be any suitable arrangement. Typically, electrical connectors are either male or female electrical connectors, and the arrangement of the head 11 will depend on whether the electrical contact 10 will be used in either a male electrical connector or a female electrical connector.

The tail 13 of the electrical contact 10 is preferably arranged to be connected to a printed circuit board 60 by fusing the solder member 20 to the tail 13 of the electrical contact 10 and to an electrical pad 61 on the printed circuit board 60, as shown in FIGS. 20-25. Typically, the arrangement of the tail 13 of the electrical contact 10 is the same, within manufacturing tolerances, whether or not the electrical contact 10 is used in a male electrical connector or a female electrical connector. By fusing the solder member 20 to the tail 13 and to the electrical pad 61, a mechanical connection and an electrical connection is formed between the electrical connector 50 and the printed circuit board 60. Fusing the solder member 20 is preferably done by re-flow soldering by placing the electrical connector 50 and the printed circuit board 60 in a reflow oven (not shown); however, any other suitable method, e.g. infrared or convection, can also be used to fuse the solder member 20 to tail 13 of the electrical contact 10 and the electrical pad 61 of the printed circuit board 60.

Preferably, the electrical contact 10 includes two arms 14 to secure the electrical contact 10 in the electrical connector 50. However, any other number of arms 14 can also be used, or no arms 14 can be used. Arms 14 are preferably arranged to engage with the electrical connector 50 such that electrical contact 10 is secured in the electrical connector 50. It is also possible to use other structures, e.g., a hemispherical boss located on the body 12 of electrical contact 10 or side barbs extending in the width direction, to secure the electrical contact 10 in the electrical connector 50.

The hole 16 is located in the tail 13 of electrical contact 10 and is arranged to engage with the extension 24 (see FIGS. 15 and 32, for example) of the solder member 20, described in more detail below. The hole 16 is formed as a result of the peg 15 being formed.

Figure 18:
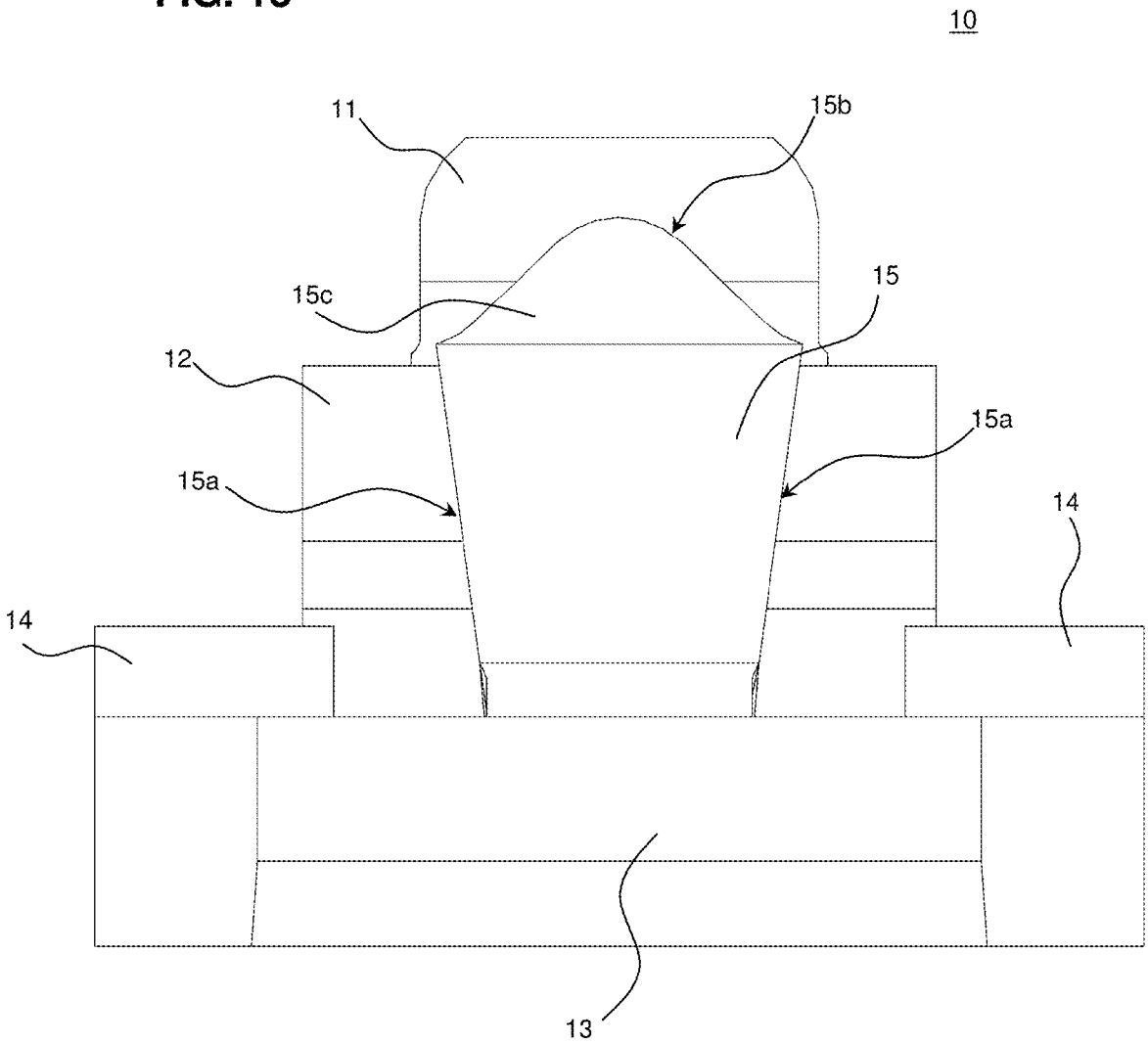
FIG. 18 is a top view of an electrical contact without a solder member according to a preferred embodiment of the present invention.
Figure 19:
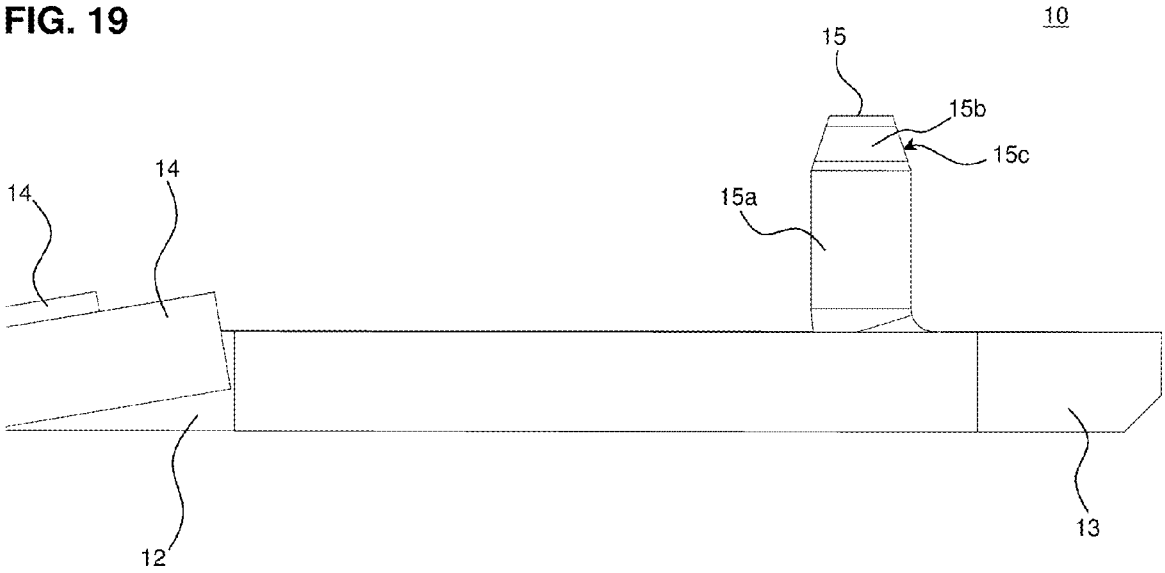
FIG. 19 is a partial side view of an electrical contact without a solder member according to a preferred embodiment of the present invention.

The peg 15 preferably includes beveled sides 15*a* and top 15*b* with beveled sides 15*c*. The beveled sides 15*a* are preferably formed such that the width of peg 15 increases in the direction extending away from a major surface defining the tail 13 of the electrical contact 10, as viewed from the top of electrical contact 10 as best seen in FIG. 18. The width of the peg 15 increases up to the top 15*b* of the electrical contact 10.

The top 15*b* of peg 15 is preferably arranged such that, starting at the far end of the beveled sides 15*a*, the width of peg 15 decreases in the direction extending away from one of the major surface of the tail 13 of the electrical contact 10, as viewed from the top of electrical contact 10, as best seen in FIG. 18. Peg 15 preferably includes an opposing pair of beveled sides 15*a*. However, it is possible to use a single beveled side or to use two sets of opposing pair of beveled sides.

Figure 30:
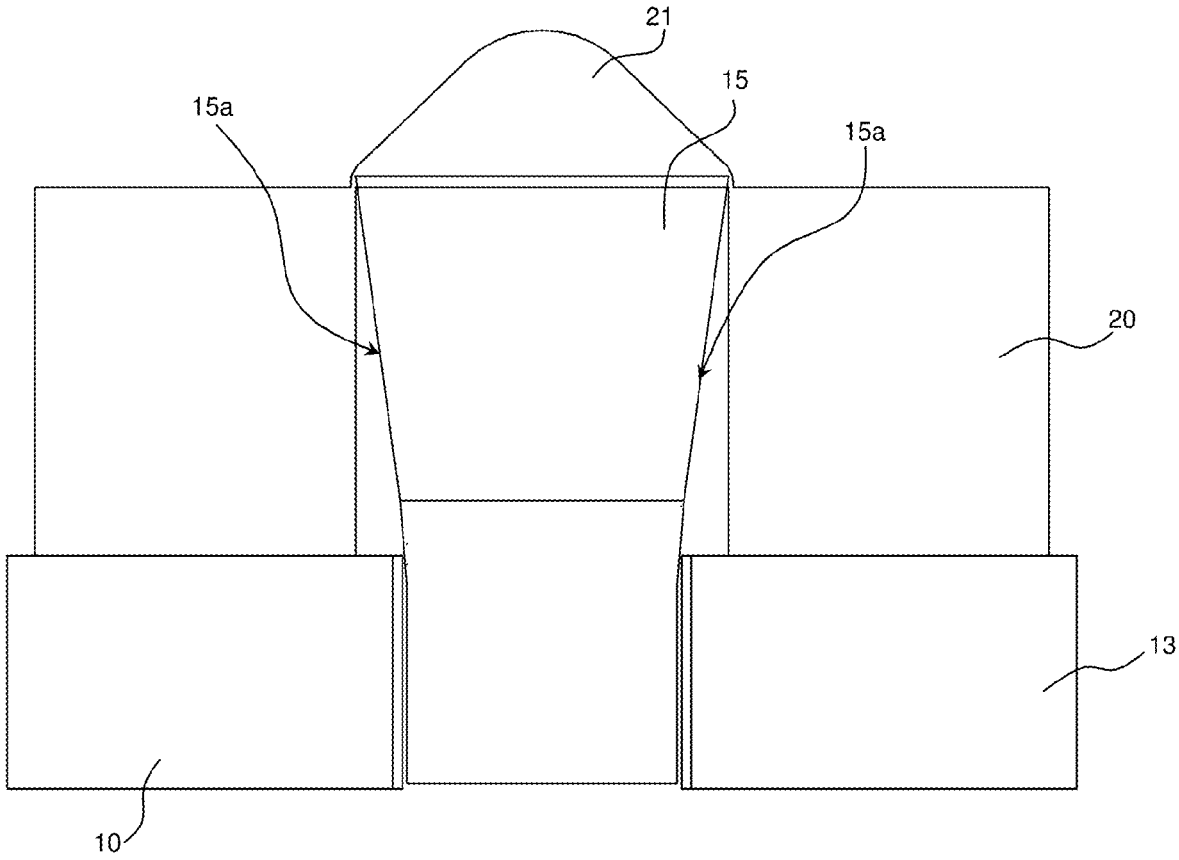
FIG. 30 is a front sectional view of an electrical contact with a solder member according to a preferred embodiment of the present invention.
Figure 31:
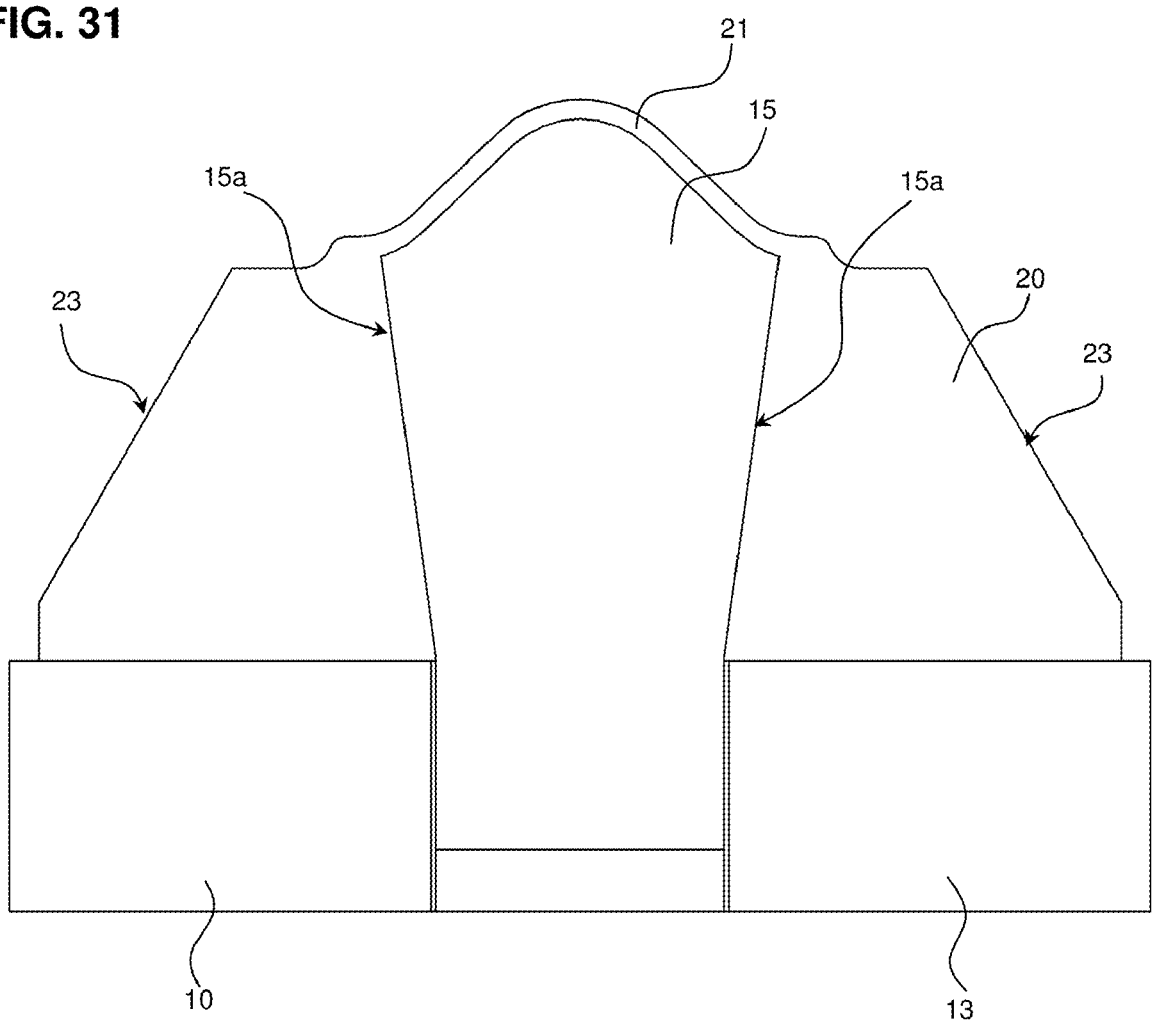
FIG. 31 is another front sectional view of an electrical contact with a solder member according to a preferred embodiment of the present invention.

As best seen in FIGS. 18, 30, and 31, the top 15*b* preferably has a bell-curve shape; however, any other suitable shape could also be used. It is also possible not to use the bell-curve shaped top 15*b* of the peg 15 such that the top of peg 15 ends where the beveled sides 15*a* end. However, without the shaped top 15*b*, it is more difficult to securely attach the solder member 20 to the peg 15. The top 15*b* of peg 15 preferably includes opposing beveled sides 15*c* that help place the solder member 20 with respect to peg 15 and help secure the solder member 20 to peg 15. Instead of using opposing beveled sides 15*c*, it is also possible to use a single beveled side 15*c*. It is also possible that the top 15*b* has, instead of bell-curve shape, a pyramid shape with two sets of opposing beveled sides 15*c*. Other suitable shapes that allow for the solder member 20 to be deformed without tearing could also be used for the top 15*b*.

Solder member 20 engages the peg 15 of the electrical contact 10. Solder member 20 includes a protrusion 21 that is formed by the top 15*b* of the peg 15 when the solder member 20 is attached to the electrical contact 10, depression 22 and corresponding extension 24 (best seen in FIGS. 15, 16, and 32) that is formed when the depression 22 is formed, and beveled sides 23.

The extension 24 of the solder member 20 is formed by pressing on the top of the solder member 20 to form the depression 22. The extension 24 extends into the hole 16 of the electrical contact 10. As seen by comparing FIGS. 30 and 31, the beveled sides 23 are formed by pressing the sides of the solder member 20 to secure the solder member 20 to the electrical contact 10 by deforming the solder member 20 to engage the beveled sides 15*a* of the peg 15.

Any suitable solder or fusible material can be used for the solder member 20, and any suitable shape can be used for the solder member 20.

The solder member 20 is securely and reliably attached to the electrical contact 10 because of the engagement of the solder member 20 with the hole 16 and with the beveled sides 15*a* and top 15*b* of the peg 15. The rotation of the solder member 20 is prevented because of the engagement of the extension 24 with the hole 16 and because of the engagement of the solder member 20 with the peg 15. Because the solder member 20 is securely and reliably attached to the peg 15, the solder member 20 performs better in 'push-out' force and shear strength tests.

Methods of Manufacturing Electrical Contacts 10 and Electrical Connectors 50

Figure 27:
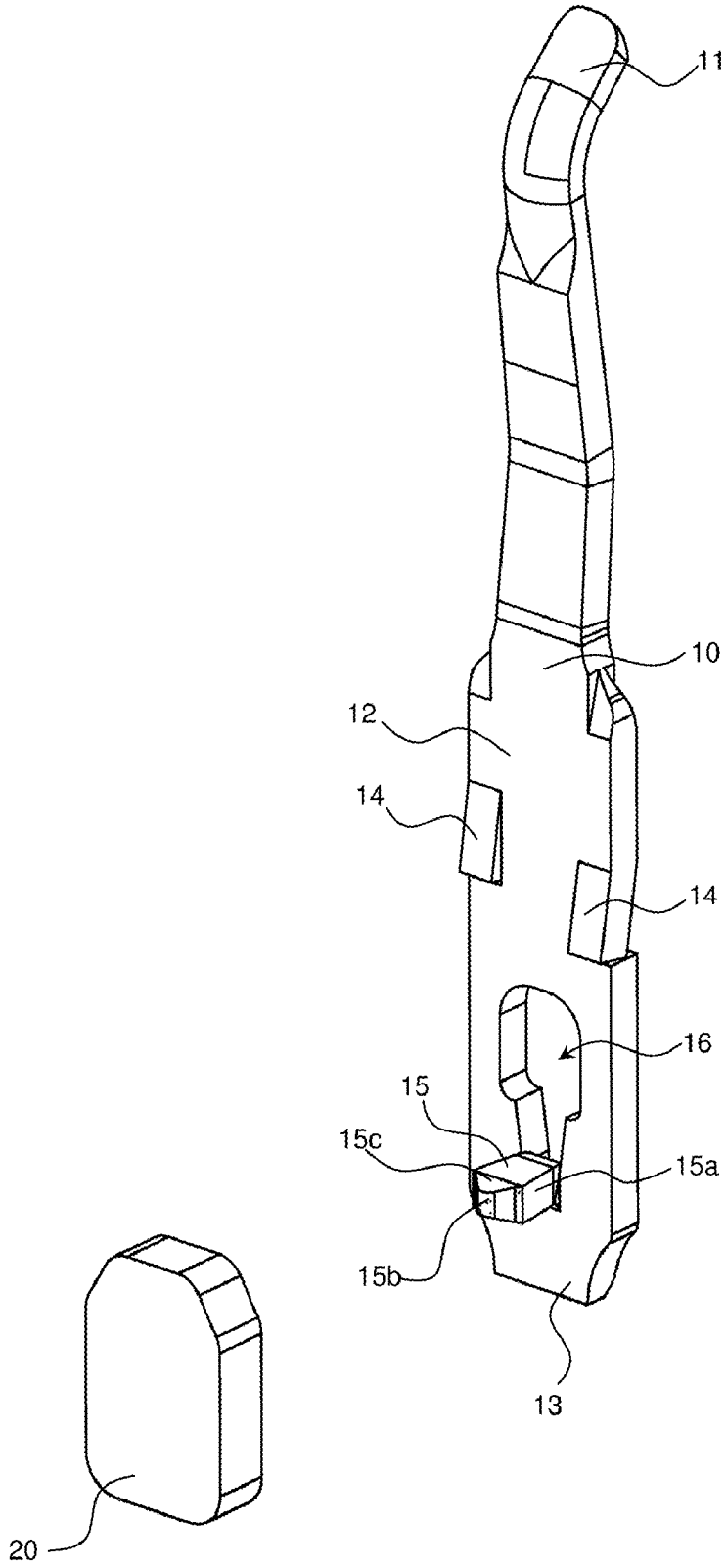
FIG. 27 is a perspective view of an electrical contact and a solder member before the solder member is attached to the electrical contact according to a preferred embodiment of the present invention.
Figure 28:
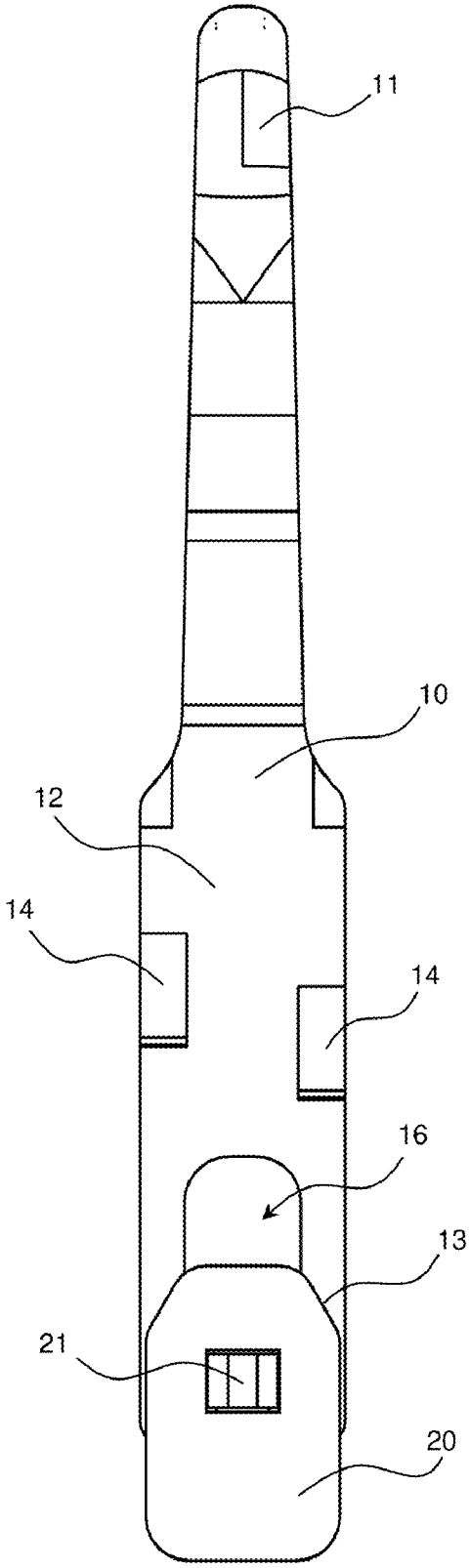
FIG. 28 is a front view of an electrical contact with a solder member according to a preferred embodiment of the present invention.
Figure 29:
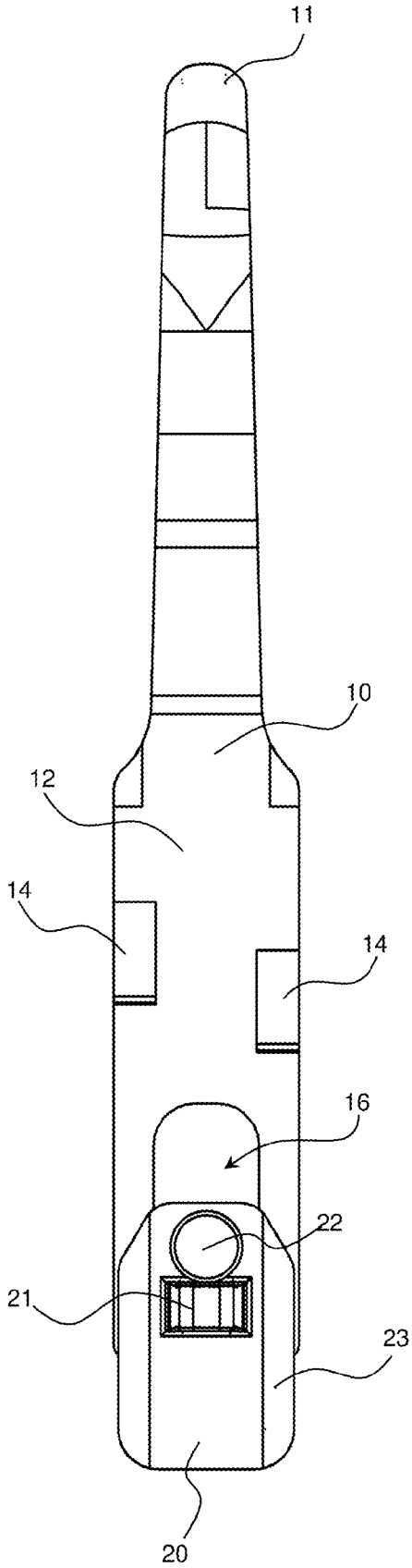
FIG. 29 is another front view of an electrical contact with a solder member according to a preferred embodiment of the present invention.

FIGS. 9, 10, and 26 show a partial ribbon 40 of electrical contacts 10 at various stages in a manufacturing process, FIGS. 11-14 shows solder member 20 at various stages in a manufacturing process, FIGS. 27-29 shows electrical contacts at various stages in a manufacturing process, and FIGS. 30 and 31 shows solder member 20 and electrical contact 10 at various stages in a manufacturing process.

First, a ribbon 40 of electrical contacts 10 is formed form a metal sheet as shown in FIG. 9. FIGS. 9, 10, and 26 only show four electrical contacts 10, but a typical ribbon will include many more electrical contacts 10. Preferably, punching and/or progressive die stamping are/is used to form the head 11, the body 12, and the tail 13 of the electrical contact 10. Heads 11 with different arrangements are formed depending on whether or not the electrical contact 10 is to be used with a male electrical connector or with a female electrical connector. Preferably, the body 12 is formed with arms 14. Then, the peg 15 is formed by punching and progressive die stamping. The hole 16 is formed by punching. Then, from the metal formed by the punching, the peg 15, including the beveled sides 15*a* and the top 15*b*, is shaped by progressive die stamping. The beveled sides 15*c* of the top 15*b* are formed by progressive die stamping. It is also possible to form the peg 15, and then form the head 11, the body 12, and the tail 13 of the electrical contact 10. Before the solder member 20 is attached to the electrical contact 10, a breakoff 41 is formed at the bottom of the tail 13 so that the electrical contact 10 can be more easily removed from the ribbon 40.

Typically, the metal sheet forming the ribbon 40 includes copper, a copper alloy, or a BeCu alloy, for example, as a base metal of the electrical contacts 10. After the head 11, the body 12, and the tail 13 are formed, an additional conductive layer or layers is preferably added to the base metal. The conductive layers typically include at least one of tin, nickel, gold, and silver, for example. However, other suitable conductive materials can be used for the base metal and the conductive layers.

Figure 11:
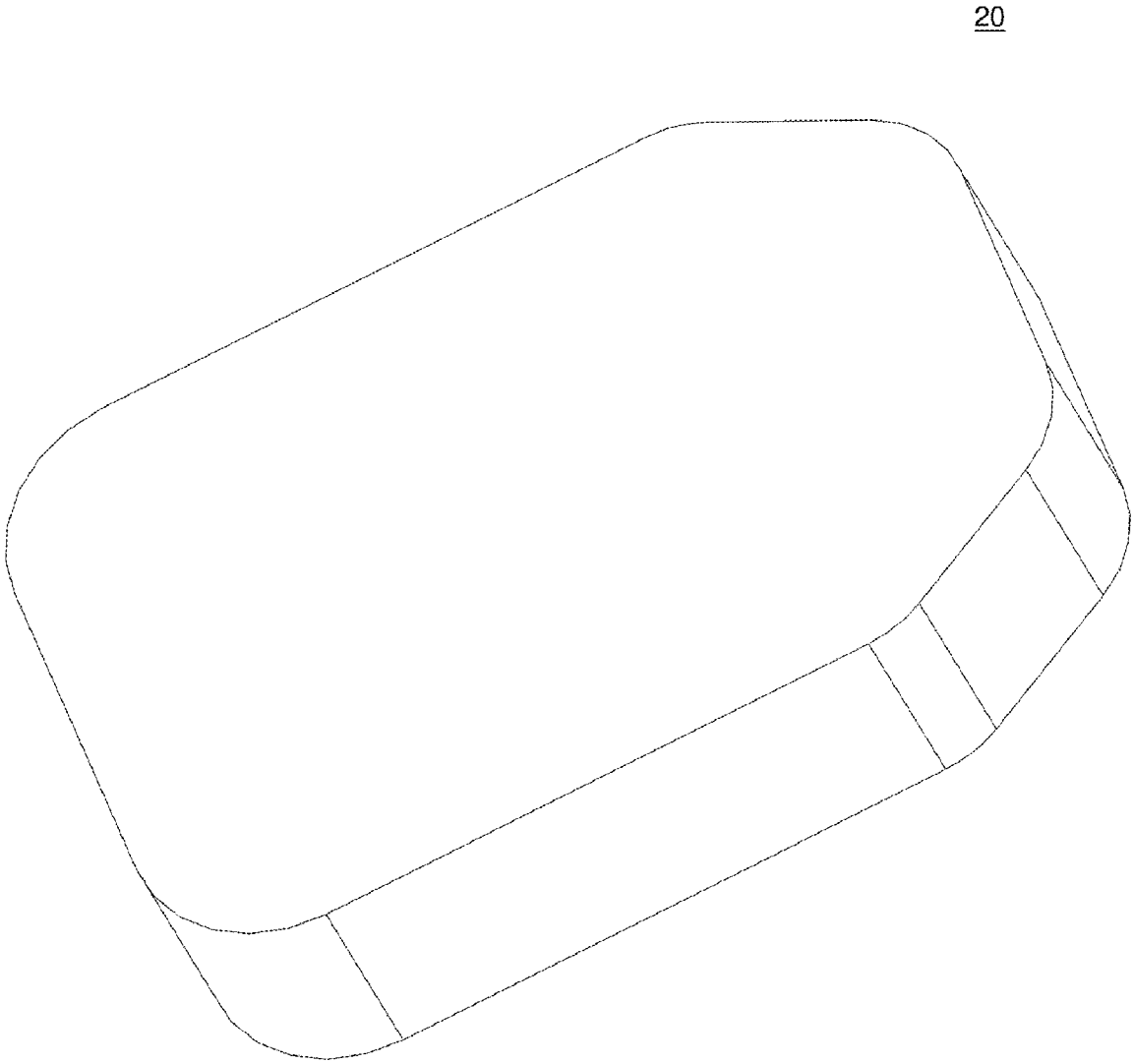
FIG. 11 is a perspective view of a solder member according to a preferred embodiment of the present invention.
Figure 12:
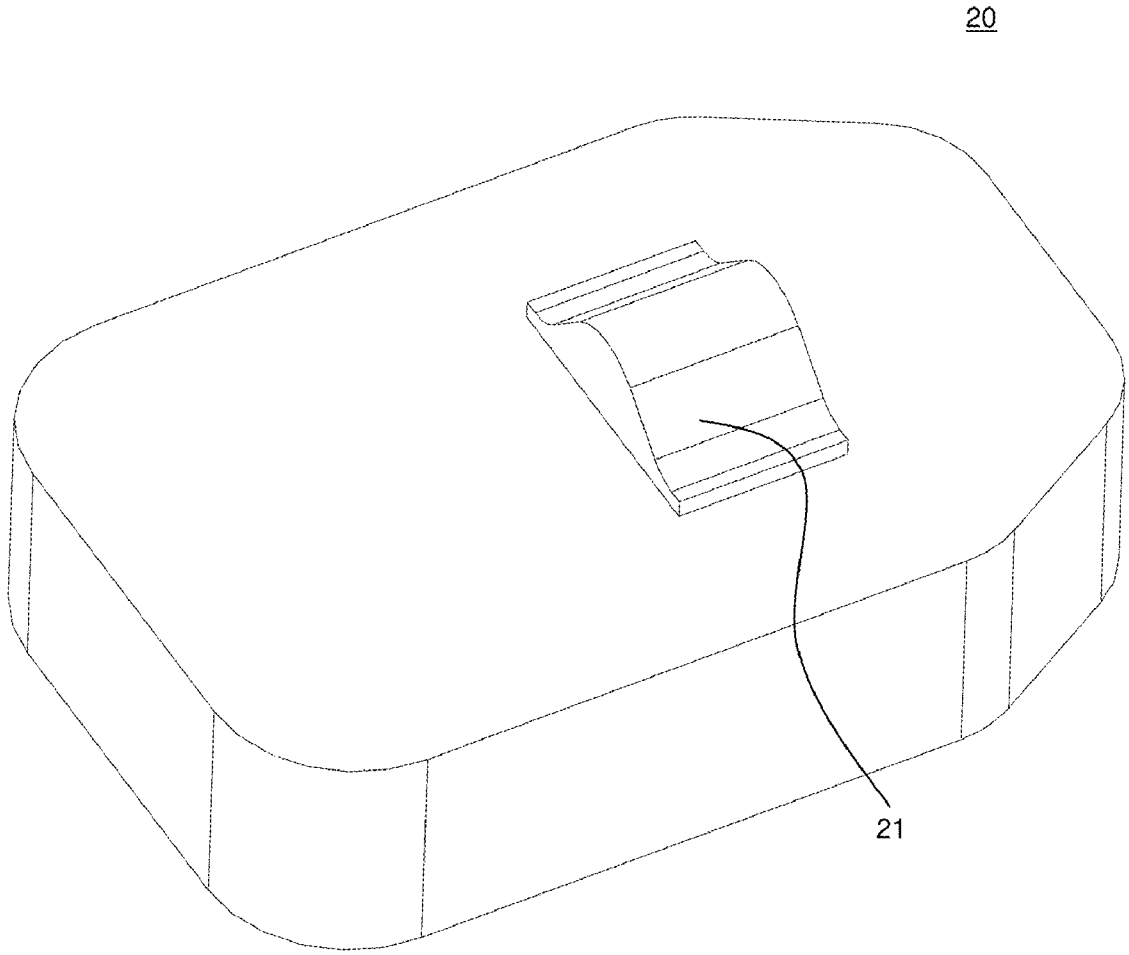
FIG. 12 is another perspective view of a solder member according to a preferred embodiment of the present invention.
Figure 13:
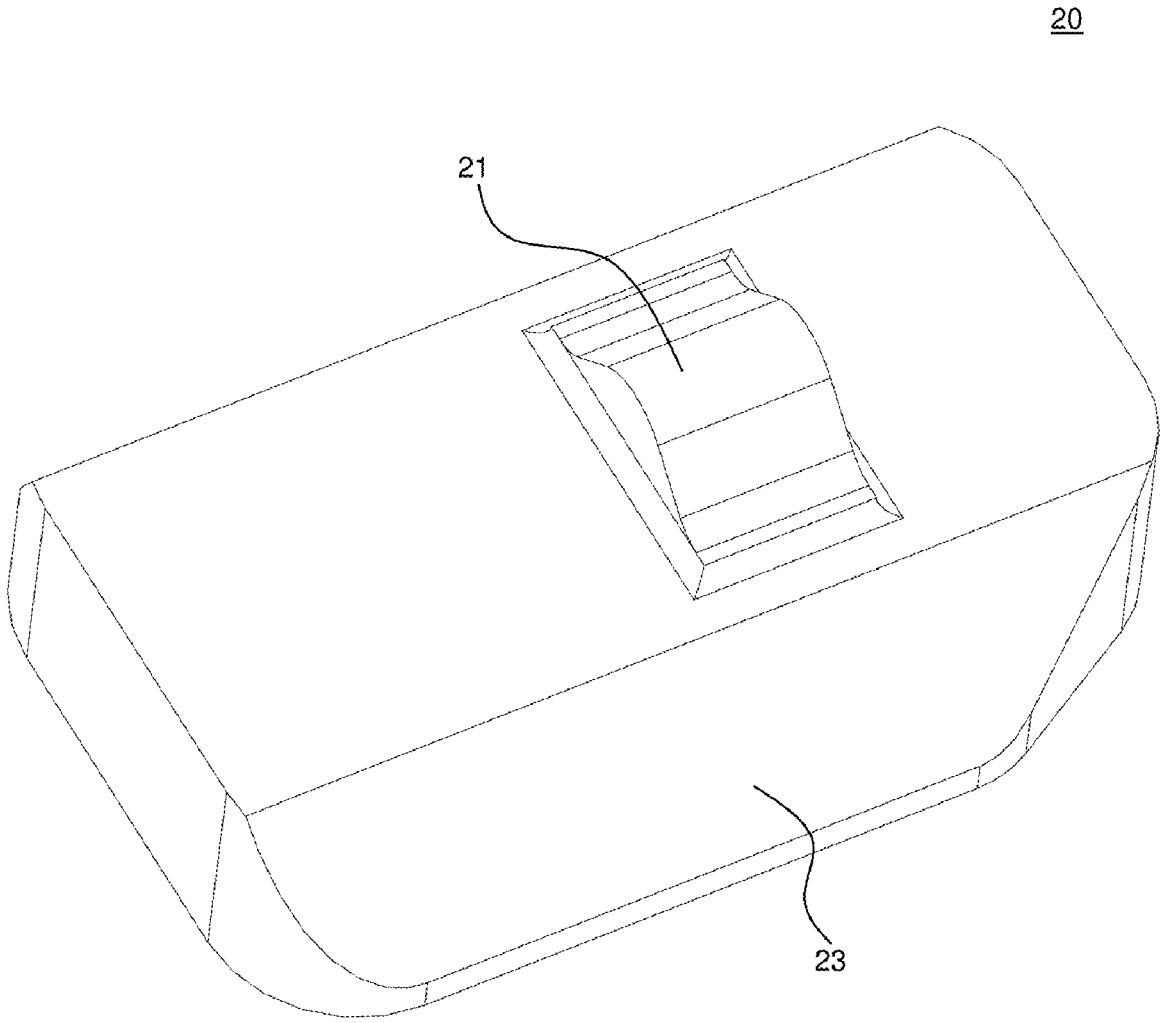
FIG. 13 is another perspective view of a solder member according to a preferred embodiment of the present invention.
Figure 14:
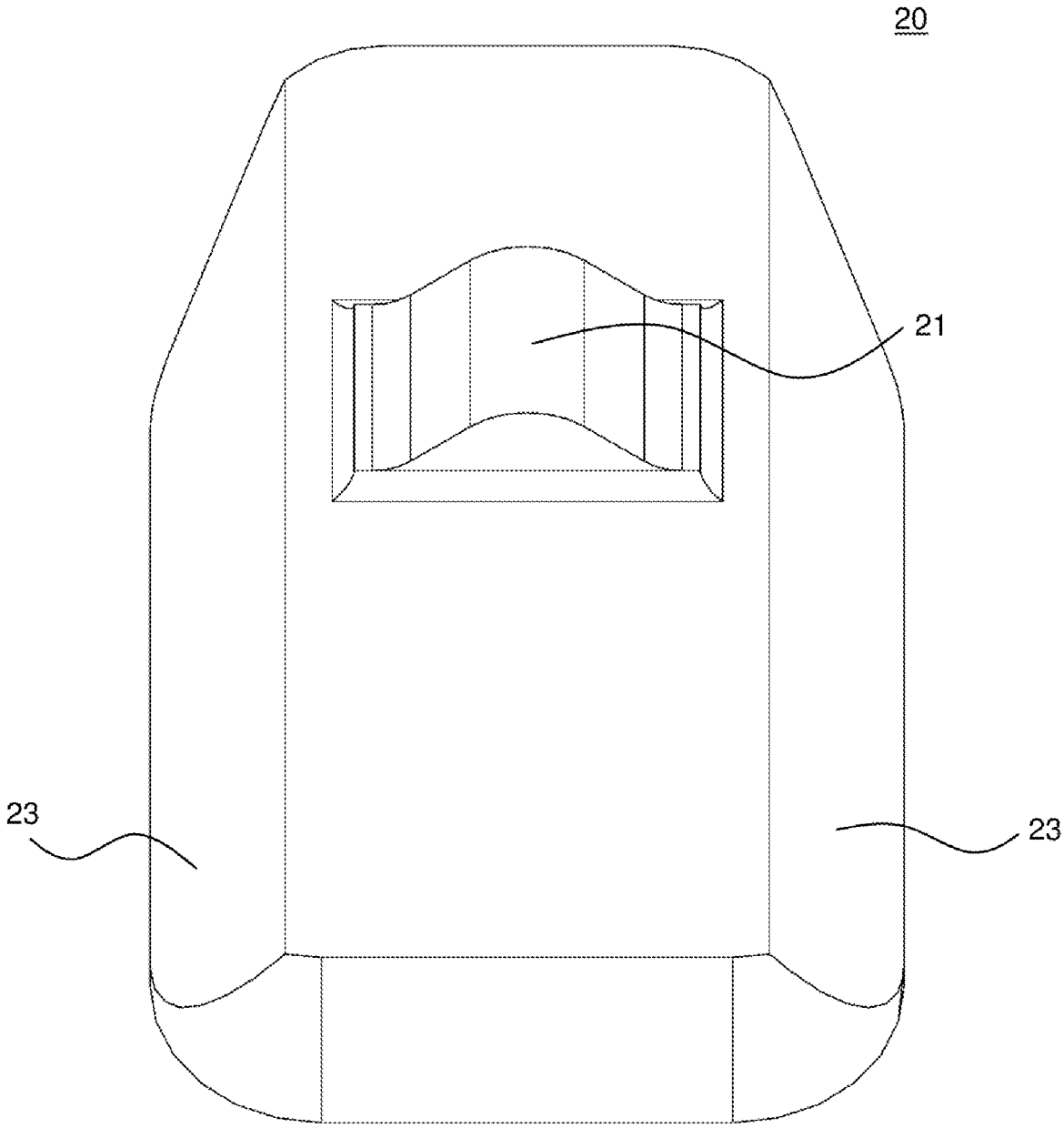
FIG. 14 is another perspective view of a solder member according to a preferred embodiment of the present invention.
Figure 15:
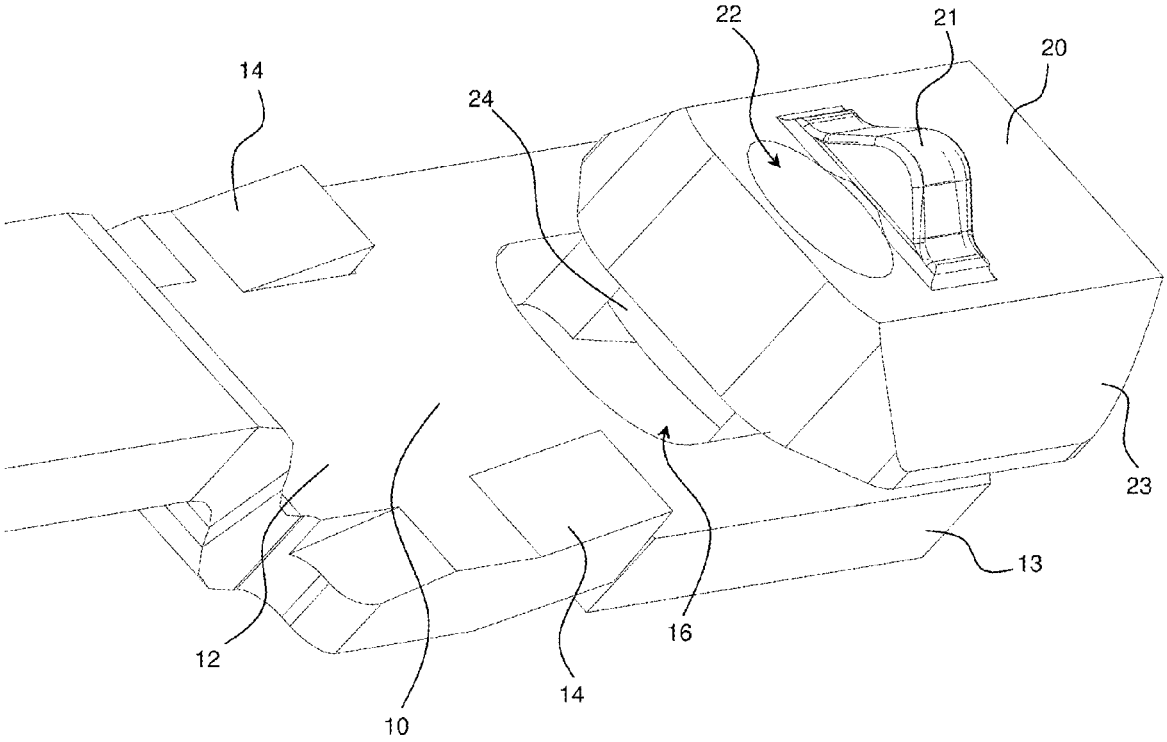
FIG. 15 is a close-up, partial top view of an electrical contact with a solder member according to a preferred embodiment of the present invention.
Figure 16:
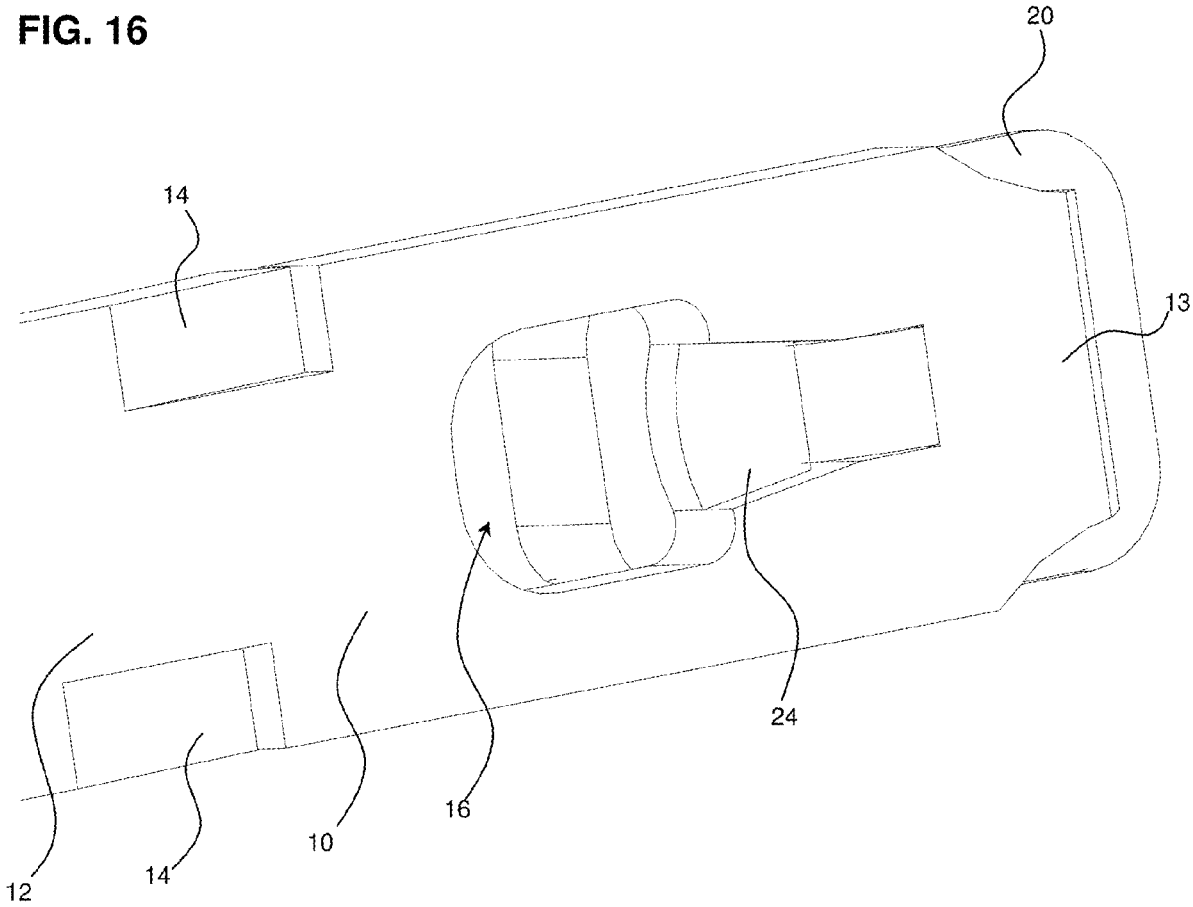
FIG. 16 is a close-up, partial bottom view of an electrical contact with a solder member according to a preferred embodiment of the present invention.
Figure 17:
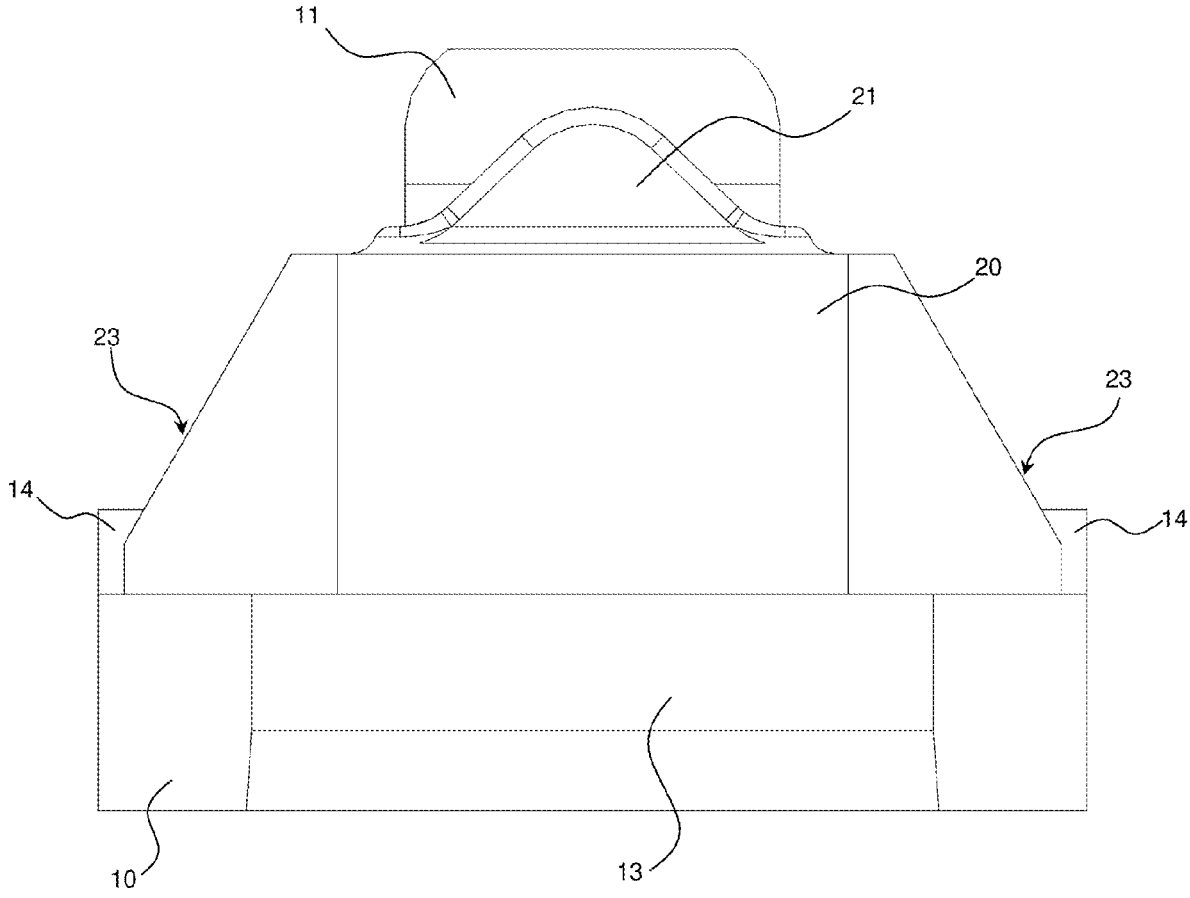
FIG. 17 is a top view of an electrical contact with a solder member according to a preferred embodiment of the present invention.

Second, as seen, for example, in the sequence of FIGS. 27-29, a solder member 20 is mechanically attached to each tail 13 of the electrical contacts 10. For simplicity, the ribbon 40 is not shown in FIGS. 27-29. Once the solder members 20 are attached, the ribbon 40 is arranged as shown FIGS. 10 and 26 with the solder members 20 attached to the electrical contacts 10. FIGS. 11-14 show the solder member 20 at various stages of the manufacturing process. For the sake of clarity, neither the ribbon 40 nor the electrical contact 10 are shown in FIGS. 11-14. FIG. 11 shows the solder member 20 and FIG. 27 shows the solder member 20 and the electrical contact 10 before the solder member 20 is attached to the electrical contact 10. The solder member 20 is pressed onto the peg 15 of the electrical contact 10, forming the protrusion 21 as shown in FIGS. 12, 28, and 30.

After the solder member 20 is pressed onto the peg 15 of the electrical contact 10, the sides of the solder member 20 are pressed to form beveled edges 23, as shown in FIGS. 13, 14, 29, and 31, so that the solder member 20 engages the beveled sides 15*a* and the top 15*b* of the peg 15. FIG. 30 is a sectional view showing the solder member 20 before the sides of the solder member 20 are pressed to form beveled edges 23, and FIG. 31 is a sectional view showing the solder member 20 after the sides of the solder member 20 are pressed to form beveled edges 23. The formation of the beveled edges 23 causes the solder member 20 to engage with the entire or substantially the entire beveled edges 15*a* of the peg 15, which secures the solder member 20 to the electrical contact 10.

Figure 32:
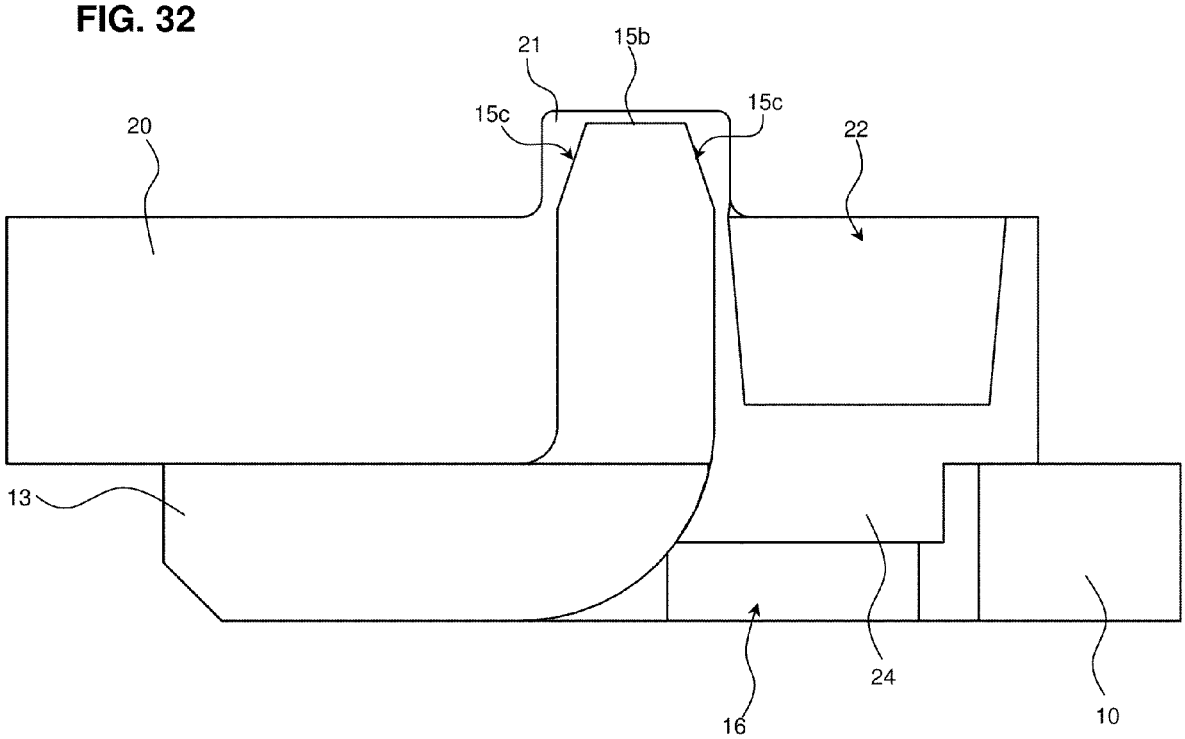
FIG. 32 is a side sectional view of an electrical contact with a solder member according to a preferred embodiment of the present invention.

After the sides of the solder member 20 are pressed, the top of the solder member 20 is pressed to form the depression 22 so that the extension 24 extends into the hole 16 of the electrical contact 10 as seen in FIG. 32. It is also possible to form the depression 22 and then form the beveled sides 23.

After the solder members 20 are attached to the electrical contacts 10, the electrical contacts 10 can be disconnected from the ribbon 40 and inserted into an electrical connector 50. It is also possible to insert the electrical contacts 10 into the electrical connector 50 while still on the ribbon 40 and then disconnect the electrical contacts 10 from the ribbon 40. It is also possible to attach the solder members 20 to the electrical contacts 10 after the electrical contact 10 have been inserted into the electrical connector 50. Because the width of the solder member 20 is preferably smaller than the tail 13 and the body 12, the electrical contact 10 can be inserted as deeply into the electrical connector 50 as desired. Thus, the distance between the bottom of the electrical connector 50 and the bottom of the electrical contact 10, including solder member 20, can be set to any desirable distance. Instead of inserting the electrical contacts 10 into the electrical connector 50, it is possible to form, e.g. by insert molding, the electrical connector 50 around the electrical contacts 10. If the electrical connector 50 is formed around the electrical connector 50, then it is not necessary to form the arms 14 on the electrical contact 10.

After the electrical connector 50 is completed, the electrical connector 50 is preferably connected to a printed circuit board 60. However, it is possible to connect the electrical connector 50 to any other suitable device.

Figure 20:
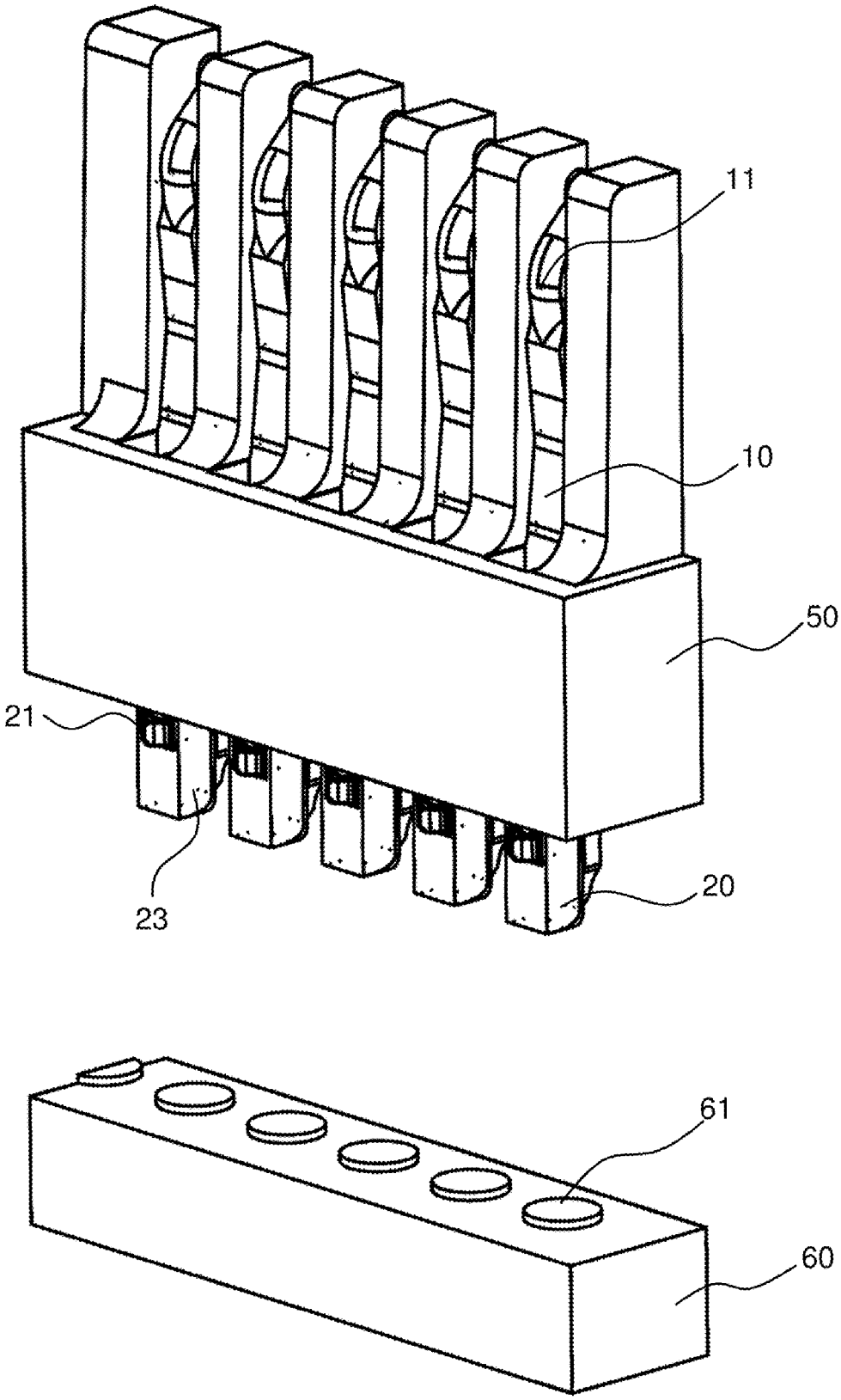
FIG. 20 is a perspective view of an electrical connector before being connected to a printed circuit board according to a preferred embodiment of the present invention.

As seen in FIG. 20, electrical pads 61 on the printed circuit board 60 are arranged in an array with a similar pattern as the electrical contacts 10 of the electrical connector 50. For simplicity, only a portion of the printed circuit board 60 is shown, and typically, the printed circuit board 60 includes structures other than electrical pads 61, e.g. electrical traces, passive components, active components, etc.

The electrical connector 50 is aligned with the printed circuit board 60 so that the solder members 20 can be soldered to corresponding electrical pads 61, as shown in FIGS. 21 and 22. Any suitable method can be used in the soldering process to solder the solder members 20 to the corresponding electrical pads 61, e.g. by using a reflow oven, infrared radiation, or convection oven.

FIG. 23 is a sectional view of an electrical contact 10 soldered to an electrical pad 61. During the soldering process, the solder member 20 reflows so that the solder member 20 extends through the hole 16 so that solder member 20 is located on all sides of the electrical contact 10 after the soldering process.

FIGS. 24 and 25 show a pair of electrical connectors 50. FIG. 24 shows the pair of electrical connectors 50 before being mated, and FIG. 25 shows the pair of electrical connectors 50 after being mated. Typically, one of the electrical connectors 50 is male, and the other electrical connector 50 is female.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. An electrical contact comprising:

a head;

a tail including an opposing pair of major surfaces and a hole;

a body connected at one end thereof to the head and at another end thereof to the tail;

a peg arranged adjacent to the hole and to extend perpendicular or substantially perpendicular to one of the opposing pair of major surfaces and including at least one beveled side; and a solder member attached to the tail such that the peg creates and fits in a protrusion in a surface of the solder member when the solder member is attached to the tail, such that a portion of the solder member extends into the hole, and such that the solder member engages the at least one beveled side of the peg.

2. An electrical contact according to claim 1, further comprising at least one arm extending from the body.

3. An electrical contact according to claim 1, wherein the peg includes a bell-curve shaped top extending above the at least one beveled side.

4. An electrical contact according to claim 1, wherein the peg includes a top extending above the at least one beveled side of the peg and including at least one top beveled side.

5. An electrical contact according to claim 1, wherein the at least one beveled side of the peg is arranged is such that a width of the peg increases in a direction extending away from the one of the opposing pair of major surfaces.

6. An electrical connector comprising at least one electrical contact according to claim 1.

7. An electrical connector according to claim 6, wherein the at least one electrical contact includes a plurality of electrical contacts arranged in an array of electrical contacts.

8. An electrical connector according to claim 6, wherein the head of the at least one electrical contact is arranged to engage with a corresponding electrical contact of another electrical connector.

9. An electrical connector according to claim 6, wherein the solder member of the at least one electrical contact is arranged to be fused to the tail of the at least one electrical contact and to be fused with an electrical pad on a printed circuit board.

10. An electrical connector system comprising:

an electrical connector including at least one electrical contact according to claim 1; and a printed circuit board including at least one electrical pad; wherein for each of the at least one electrical contact, the solder member is fused to the tail of the electrical contact and is fused to a corresponding one of the at least one electrical pad.

11. A method of manufacturing an electrical contact, comprising the steps of:

providing an electrical contact including a head, a tail including an opposing pair of major surfaces and a hole, and a body connected at one end thereof to the head and at another end thereof to the tail;

forming a peg adjacent to the hole so that the peg extends perpendicular or substantially perpendicular to one of the opposing pair of major surfaces and includes at least one beveled side; and attaching a solder member to the tail such that the peg creates and fits in a protrusion in a surface of the solder member, such that a portion of the solder member extends into the hole, and such that the solder member engages the at least one beveled side of the peg.

12. A method of manufacturing an electrical contact according to claim 11, wherein the step of attaching includes forming a depression in the solder member such that the portion of the solder member extending into the hole is formed.

13. A method of manufacturing an electrical contact according to claim 11, wherein the step of attaching includes pressing the solder member to form beveled sides in the solder member so that the solder member engages the at least one beveled side of the peg.

14. A method of manufacturing an electrical contact according to claim 11, further comprising forming at least one arm extending from the body.

15. A method of manufacturing an electrical contact according to claim 11, wherein the step of forming the peg includes forming a bell-curve shaped top extending above the at least one beveled side.

16. A method of manufacturing an electrical contact according to claim 11, wherein the step of forming the peg includes forming a top extending above the at least one beveled side of the peg and including at least one top beveled side.

17. A method of manufacturing an electrical contact according to claim 11, wherein the at least one beveled side of the peg is arranged is such that a width of the peg increases in a direction extending away from the one of the opposing pair of major surfaces.

18. A method of manufacturing an electrical connector comprising providing an electrical connector with at least one electrical contact formed according to the method of claim 11.

19. A method of manufacturing an electrical connector system comprising:

providing an electrical connector with at least one electrical contact formed according to the method of claim 11;

providing a printed circuit board including at least one electrical pad; and fusing the solder member for each of the at least one electrical contact to the tail of the electrical contact and to a corresponding one of the at least one electrical pad.

20. A ribbon of electrical contacts comprising:

a ribbon; and electrical contacts connected to the ribbon, each of the electrical contacts including:

a head;

a tail including a hole and a peg and connected to the ribbon such that a bottom portion of the tail is the only portion of the electrical contact connected to the ribbon; and a solder member connected to the tail such that a portion of the solder member surrounds the peg, such that a portion of the solder member is located within the hole, and such that the solder member overlaps both the tail and the ribbon.

* * * * *